US010916164B2

(12) United States Patent
Song et al.

(10) Patent No.: US 10,916,164 B2
(45) Date of Patent: Feb. 9, 2021

(54) SAMPLING METHOD AND DEVICE, SAMPLING CONTROL METHOD, DEVICE AND SYSTEM, AND DISPLAY DEVICE

(71) Applicant: BOE TECHNOLOGY GROUP CO., LTD., Beijing (CN)

(72) Inventors: Chen Song, Beijing (CN); Tangxiang Wang, Beijing (CN); Zhan Gao, Beijing (CN); Song Meng, Beijing (CN); Dongfang Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/348,315

(22) PCT Filed: Aug. 28, 2018

(86) PCT No.: PCT/CN2018/102754
§ 371 (c)(1),
(2) Date: May 8, 2019

(87) PCT Pub. No.: WO2019/114322
PCT Pub. Date: Jun. 20, 2019

(65) Prior Publication Data

US 2020/0265760 A1 Aug. 20, 2020

(30) Foreign Application Priority Data

Dec. 15, 2017 (CN) ..... 2017 1 1350617

(51) Int. Cl.
*G09G 3/3233* (2016.01)
*G09G 3/00* (2006.01)

(52) U.S. Cl.
CPC ..... *G09G 3/006* (2013.01); *G09G 3/3233* (2013.01); *G09G 2320/0233* (2013.01); *G09G 2320/0295* (2013.01)

(58) Field of Classification Search
CPC .. G09G 3/3266; G09G 3/3258; G09G 3/3233; G09G 3/3275; G09G 3/006; G09G 2320/0233; G09G 2320/0295
See application file for complete search history.

(56) References Cited

U.S. PATENT DOCUMENTS

2015/0179105 A1* 6/2015 Mizukoshi ..... G09G 3/3266 345/76
2015/0379909 A1* 12/2015 Yu ..... G09G 3/3258 345/690

(Continued)

FOREIGN PATENT DOCUMENTS

CN 101266753 A 9/2008
CN 104036722 A 9/2014

(Continued)

OTHER PUBLICATIONS

International Search Report and Written Opinion dated Dec. 5, 2018 from State Intellectual Property Office of the P.R. China.

*Primary Examiner* — Richard J Hong
(74) *Attorney, Agent, or Firm* — Dilworth & Barrese, LLP.; Michael J. Musella, Esq.

(57) ABSTRACT

The present disclosure discloses a sampling method, a sampling control method, a sampling device, a sampling control device, a sampling control system, and a display device. The present disclosure provides a sampling method for sampling pixel units disposed on a display substrate, the method including: the controller controlling a plurality of sampling modules to be simultaneously turned on, so that a plurality of sampling modules controlled by the controller are capable of receiving luminance information of the pixel units obtained through sampling of the sampling channel; the controller sequentially controlling a group of sampling channels to be simultaneously turned on, so that the group of sampling channels simultaneously sample the luminance (Continued)

information, and transmit the sampled luminance information to respective sampling modules connected to the group of sampling channels through the output terminals of the group of sampling channels.

20 Claims, 19 Drawing Sheets

(56) References Cited

U.S. PATENT DOCUMENTS

| | | | | |
|---|---|---|---|---|
| 2017/0154573 | A1* | 6/2017 | Woo | G09G 3/3266 |
| 2019/0051251 | A1* | 2/2019 | Hwang | G09G 3/3233 |
| 2019/0189058 | A1* | 6/2019 | Cho | G09G 3/3275 |

FOREIGN PATENT DOCUMENTS

| | | | |
|---|---|---|---|
| CN | 107016964 | A | 9/2014 |
| CN | 106297659 | A | 1/2017 |
| CN | 108198527 | A | 6/2018 |
| KR | 1020120063049 | A | 6/2012 |

* cited by examiner

SAMPLING METHOD AND DEVICE, SAMPLING CONTROL METHOD, DEVICE AND SYSTEM, AND DISPLAY DEVICE

TECHNICAL FIELD

The present disclosure relates to the electrical field, and in particular, to a sampling method, a sampling control method, a sampling device, a sampling control device, a sampling control system, and a display device.

BACKGROUND

Currently, the display panel technology, such as the Organic Light-Emitting Diode (OLED) technology, is confronted with a major problem, which is inconsistent luminance of each pixel unit in the display panel, resulting in uneven luminance of the display panel. In some cases, the luminance of each pixel unit is adjusted by electrical compensation technique. The electrical compensation technique is to sample each pixel unit by using a sampling module in the driving chip, obtain luminance information of the pixel unit, and then input the luminance information into a timing control module (T-CON) to adjust the luminance of the pixel unit. As the integration degree of the driving chip is higher and higher, the resolution of the display panel is also higher and higher, and accordingly, the sampling speed requirement for sampling the luminance information of the pixel unit by the driving chip is also higher and higher. In some cases, a sampling method is adopted in which a sampling module in the driving chip sequentially samples each pixel unit, and the sampling time required is longer.

SUMMARY

The embodiment of the present disclosure provides a sampling method, a sampling control method, a sampling device, a sampling control device, a sampling control system, and a display device, which are configured to shorten the time of sampling luminance information of pixel units, thereby improving the speed for adjusting the luminance of the pixel units, and improving the luminance uniformity of the display panel.

An embodiment of the present disclosure provides a sampling method for sampling pixel units disposed on a display substrate, the method comprising: the controller controlling a plurality of sampling modules to be simultaneously turned on, so that a plurality of sampling modules controlled by the controller are capable of receiving and saving luminance information of the pixel units obtained through sampling of the sampling channel; wherein, each sampling module is connected to a plurality of sampling channels, each sampling channel includes an input terminal and an output terminal, the input terminal is configured to sample luminance information of pixel units of a partial region on the display substrate, and the output terminal is configured to transmit the luminance information obtained by sampling to a sampling module connected to the sampling channel; the sampling module is configured to receive and save luminance information input by the sampling channel; the controller sequentially controlling a group of sampling channels to be simultaneously turned on, so that the group of sampling channels simultaneously sample the luminance information, and transmit the sampled luminance information to respective sampling modules connected to the group of sampling channels through the output terminals of the group of sampling channels; wherein, the sampling channels that are turned on at the same time are a group of sampling channels, and respective sampling channels in each group of sampling channel are connected to different sampling modules respectively.

According to the sampling method provided by an embodiment of the present disclosure, by controlling a plurality of sampling modules simultaneously sample the luminance information of pixel units corresponding to respective sampling modules, the time for sampling luminance information of pixel units is shortened, thereby improving the speed for adjusting the luminance of the pixel units, and improving the luminance uniformity of the display panel.

According to the sampling method provided by an exemplary embodiment of the present disclosure, when the controller receives a sampling mode selection signal sent by the processor, the step of controlling the plurality of sampling modules to be simultaneously turned on is performed.

According to the sampling method provided by an exemplary embodiment of the present disclosure, the method further comprises: when the controller receives the calibration mode selection signal sent by the processor, the controller controls the plurality of sampling modules to be sequentially turned on, so that the plurality of sampling modules controlled by the controller are capable of receiving and saving the output signals of the output terminals of the sampling channel; wherein, after controlling each sampling module to be turned on, the controller controls a plurality of sampling channels connected to the sampling module to be sequentially turned on, so that the input terminal of the sampling channel sequentially receives the signal input by a calibration source, and performs sampling on the calibration source; wherein, the calibration source is configured to provide a standard signal to the input terminal of the sampling channel when the controller receives the calibration mode selection signal sent by the processor.

According to the sampling method provided by an exemplary embodiment of the present disclosure, the input signals of the input terminals of respective sampling channels are the same, which are a standard signal provided by a same calibration source.

According to the sampling method provided by an exemplary embodiment of the present disclosure, the controller and the sampling module are disposed in a same sampling chip, the method further comprising: after the controller determines that the driving chip to which the controller belongs completes sampling, the controller sends a cascade control signal to a controller in a next driving chip cascaded with the driving chip to which the logic control circuit belongs, so that the controller in the next driving chip controls a plurality of sampling modules in the next driving chip to be sequentially turned on.

According to the sampling method provided by an exemplary embodiment of the present disclosure, the method further comprising: when receiving an output command signal sent by the processor, the controller controls respective sampling modules to send the saved signals from the respective sampling channels to the processor.

According to the sampling method provided by an exemplary embodiment of the present disclosure, the method comprising: the processor determines that the controller needs to operate in a sampling mode; the processor sends a sampling mode selection signal to the controller, so that the controller controls the plurality of sampling modules to be simultaneously turned on, and the plurality of sampling modules controlled by the controller are capable of receiving and saving the luminance information of the pixel unit obtained through sampling of the sampling channel; wherein, each sampling module is connected to a plurality of sampling channels, each sampling channel includes an input terminal and an output terminal, the input terminal is configured to sample luminance information of pixel units of a partial region on the display substrate, and the output terminal is configured to transmit the luminance information obtained by sampling to a sampling module connected to the sampling channel; the sampling module is configured to receive and save luminance information input by the sampling channel; and, the controller sequentially controls a group of sampling channels to be simultaneously turned on, so that the group of sampling channels simultaneously sample the luminance information, and transmit the sampled luminance information to respective sampling modules connected to the group of sampling channels through the output terminal of the group of sampling channels; wherein, the sampling channels that are turned on at the same time are a group of sampling channels, and respective sampling channels in each group of sampling channel are connected to different sampling modules respectively.

Correspondingly, an embodiment of the present disclosure provides a sampling control method, the method further comprises: the processor determines that the controller is required to operate in the calibration mode; the processor sends a calibration mode selection signal to the controller, so that the controller controls the plurality of sampling modules to be sequentially turned on, and the plurality of sampling modules controlled by the controller are capable of receiving and saving the output signal from the output terminal of the sampling channel; wherein, after the controller controlling each sampling module to be turned on, the controller controls a plurality of sampling channels connected to the sampling module to be sequentially turned on, so that the input terminal of the sampling channel sequentially receives a signal input by the calibration source, and the calibration source is sampled; wherein, the calibration source is configured to provide a standard signal to the input terminal of the sampling channel, when the controller receives the calibration mode selection signal sent by the processor.

According to the sampling control method provided by an exemplary embodiment of the present disclosure, the method further comprises: the processor acquires sampling results from respective sampling channels which are saved in the sampling module controlled by the controller after the first time period; the processor sends an output command signal to the controller, so as to acquire output signals of output terminals of respective sampling channels which are saved in respective sampling modules controlled by the controller; wherein, the first duration is greater than or equal to the duration during which sampling of the sampling channels corresponding to all the sampling modules controlled by the controller is completed.

According to the sampling control method provided by an exemplary embodiment of the present disclosure, the method further comprises: with respect to the sampling results provided when the controller operates in the calibration mode, the processor performs the following calibration steps: sequentially receiving output signals of output terminals of respective sampling channels input by the plurality of sampling modules; calculating a sampling mean value of the output signals according to the output signals; comparing output signals of output terminals of respective sampling channels connected to the sampling modules with the sampling mean value, and obtaining a calibration value of the sampling channel corresponding to the sampling module according to the comparison result; generating and storing a correspondence table between the calibration value and the sampling channel.

According to the sampling control method provided by an exemplary embodiment of the present disclosure, the method further comprises: with respect to the sampling result provided when the controller operates in the sampling mode, the processor performs the following processing steps: looking up a pre-acquired calibration value corresponding to the sampling channel in a correspondence table between the calibration value and the sampling channel; calibrating the sampling result of the sampling channel by using the pre-acquired calibration value.

According to the sampling control method provided by an exemplary embodiment of the present disclosure, the calibration value of the sampling channel is obtained by using the output signal of the output terminal which is input in the calibration mode by a plurality of sampling channels, and the luminance information of the pixel units input by the sampling channel in the sampling mode is calibrated, thereby eliminating the sampling error caused by the different sampling parameters of the sampling channel and the sampling module and improving the accuracy of the sampling result.

According to the sampling control method provided by an exemplary embodiment of the present disclosure, the sampling mean value is an average value obtained by performing a normal distribution operation on the output signals.

According to the sampling control method provided by an exemplary embodiment of the present disclosure, the calibration value is a ratio of the output signal to the calibration mean value.

Correspondingly, an embodiment of the present disclosure provides a sampling device for sampling pixel units disposed on a display substrate, the device comprising: a first unit, which is configured to control a plurality of sampling modules to be simultaneously turned on, so that the plurality of sampling modules are capable of receiving and saving the luminance information of the pixel units obtained through sampling of the sampling channel; wherein, each sampling module is connected to a plurality of sampling channels, each sampling channel includes an input terminal and an output terminal, the input terminal is configured to sample luminance information of pixel units of a partial region on the display substrate, and the output terminal is configured to transmit the luminance information obtained by sampling to a sampling module connected to the sampling channel; the sampling module is configured to receive and save luminance information input by the sampling channel; a second unit, which is configured to sequentially control a group of sampling channels to be simultaneously turned on, so that the group of sampling channels simultaneously samples the luminance information, and transmits the sampled luminance information to respective sampling modules connected to the group of sampling channels through output terminals of the group of sampling channels; wherein, the sampling channels that are turned on at the same time belong to a group of sampling channels, and respective sampling channels in each group of sampling channels are connected to different sampling modules respectively.

According to the sampling device provided by an exemplary embodiment of the present disclosure, when the first unit receives a sampling mode selection signal sent by the processor, the step of controlling the plurality of sampling modules to be simultaneously turned on is performed.

According to the sampling device provided by an exemplary embodiment of the present disclosure, wherein the device further comprises: further includes: a calibration sampling unit; the calibration sampling unit is configured to: when the first unit receives the calibration mode selection signal sent by the processor, the plurality of sampling modules are sequentially turned on, so that the plurality of sampling modules are capable of receiving and saving the output signal of the output terminal of the sampling channel; wherein, after controlling each sampling module to be turned on, the first unit controls the plurality of sampling channels connected to the sampling module are sequentially turned on, so that the input terminal of the sampling channel sequentially receives the signal input by the calibration source, and samples the calibration source; wherein, the calibration source is configured to provide a standard signal to the input terminal of the sampling channel when the controller receives the calibration mode selection signal sent by the processor.

According to the sampling device provided by an exemplary embodiment of the present disclosure, the input signals of the input terminals of respective sampling channels are the same, which are a standard signal provided by a same calibration source.

According to the sampling device provided by an exemplary embodiment of the present disclosure, the first unit and the sampling module are disposed in a same sampling chip, and the calibration sampling unit is further configured to: after the first unit determines that the sampling chip to which the first unit belongs completes sampling, the first unit sends a cascade control signal to a first unit of a next sampling chip that is cascaded with the sampling chip to which the first unit belongs, so that the first unit in the next sampling chip controls a plurality of sampling modules in the next sampling chip to be sequentially turned on.

According to the sampling device provided by an exemplary embodiment of the present disclosure, the device further comprising: an information input unit; the information input unit is configured to: when receiving an output command signal sent by the processor, the controller controls respective sampling modules to send the saved signals from the respective sampling channels to the processor.

Correspondingly, an embodiment of the present disclosure provides a sampling control device, the device comprising: a third unit, which is configured to determine a mode in which the controller needs to operate; a fourth unit, which is configured to, when the third unit determines that the controller needs to operate in the sampling mode, send a sampling mode selection signal to the controller, so that the controller controls a plurality of sampling modules to be simultaneously turned on, and the plurality of sampling modules controlled by the controller are capable of receiving and saving luminance information of the pixel units obtained through sampling of the sampling channel; wherein, each sampling module is connected to the plurality of sampling channels, each sampling channel includes an input terminal and an output terminal, said input terminal is configured to sample luminance information of pixel units of a partial region on the display substrate, and said output terminal is configured to transmit the luminance information obtained by sampling to a sampling module connected to the sampling channel; the sampling module is configured to receive and save luminance information input by the sampling channel; and the controller sequentially controls a group of sampling channels to be simultaneously turned on, so that the group of sampling channels simultaneously sample the luminance information, and transmit the sampled luminance information to respective sampling modules connected to the group of sampling channels through the output terminal of the group of sampling modules; wherein, the sampling channels that are turned on at the same time belong to a group of sampling channels, and respective sampling channels in each group of sampling channels are connected to different sampling modules respectively.

According to the sampling control device provided by an exemplary embodiment of the present disclosure, said fourth unit is further configured to: when the third unit determines that the controller is required to operate in the calibration mode, send a calibration mode selection signal to the controller, so that the controller controls the plurality of sampling modules to be sequentially turned on, and the plurality of sampling modules controlled by the controller are capable of receiving and saving an output signal of the output terminal of the sampling channel; wherein, after controlling each of the sampling modules to be turned on, the controller controls a plurality of sampling channels connected to the sampling module to be sequentially turned on, so that the input terminal of the channel sequentially receives the signal input by the calibration source, and samples the calibration source; wherein, the calibration source is configured to provide a standard signal to the input terminal of the sampling channel when the controller receives the calibration mode selection signal sent by the processor.

According to the sampling control device provided by an exemplary embodiment of the present disclosure, the device further comprises: a send instruction unit, which is configure to: obtain sampling results from the respective sampling channels which are saved in the sampling module controlled by the controller after the first time period; send an output command signal to the controller, so as to acquire output signals of output terminals of respective sampling channels saved by respective sampling modules controlled by the controller; wherein, the first duration is greater than or equal to the duration during which sampling of the sampling channels corresponding to all the sampling modules controlled by the controller is completed.

According to the sampling control device provided by an exemplary embodiment of the present disclosure, the device further comprises: a calculating unit; with respect to the sampling results provided when the controller is operating in the calibration mode, the calculation unit performs the following calibration steps: receiving sequentially output signals of output terminals of respective sampling channels input by the plurality of sampling modules; calculating a sampling mean value of the output signals according to the output signals; comparing the output signals of output terminals of respective sampling channels connected to the sampling module with the sampling mean value, and obtaining a calibration value of the sampling channel corresponding to the sampling module according to the comparison result; generating and storing a table of correspondence between the calibration value and the sampling channel.

According to the sampling control device provided by an exemplary embodiment of the present disclosure, the device further comprises: a calibration unit; with respect to the sampling result provided when the driving chip operates in the sampling mode, the calibration unit performs the following processing steps: looking up a pre-acquired calibration value corresponding to the sampling channel in the table of correspondence between the calibration value and the sampling channel; calibrating the sampling result of the sampling channel by using the pre-acquired calibration value.

According to the sampling control device provided by an exemplary embodiment of the present disclosure, the sampling mean value is an average value obtained by performing a normal distribution operation on the output signals.

According to the sampling control device provided by an exemplary embodiment of the present disclosure, the calibration value is a ratio of the output signal to the calibration mean value.

Correspondingly, an embodiment of the present disclosure provides a sampling control system, comprising any sampling device described above.

According to the above-mentioned sampling control system provided by an exemplary embodiment of the present disclosure, it further comprises any sampling control device described above.

Correspondingly, an embodiment of the present disclosure provides a display device, comprising any sampling control system described above.

DETAILED DESCRIPTION OF THE EMBODIMENTS

In order to make the objects, technical solutions and advantages of the present disclosure more clear, the present disclosure will be further described in detail with reference to the accompanying drawings. Apparently, the described embodiments are only part of the embodiments of the present disclosure, but not all of the embodiments. Based on the embodiments of the present disclosure, all other embodiments obtained by those skilled in the art without creative efforts belong to the protection scope of the present disclosure.

Figure 1:
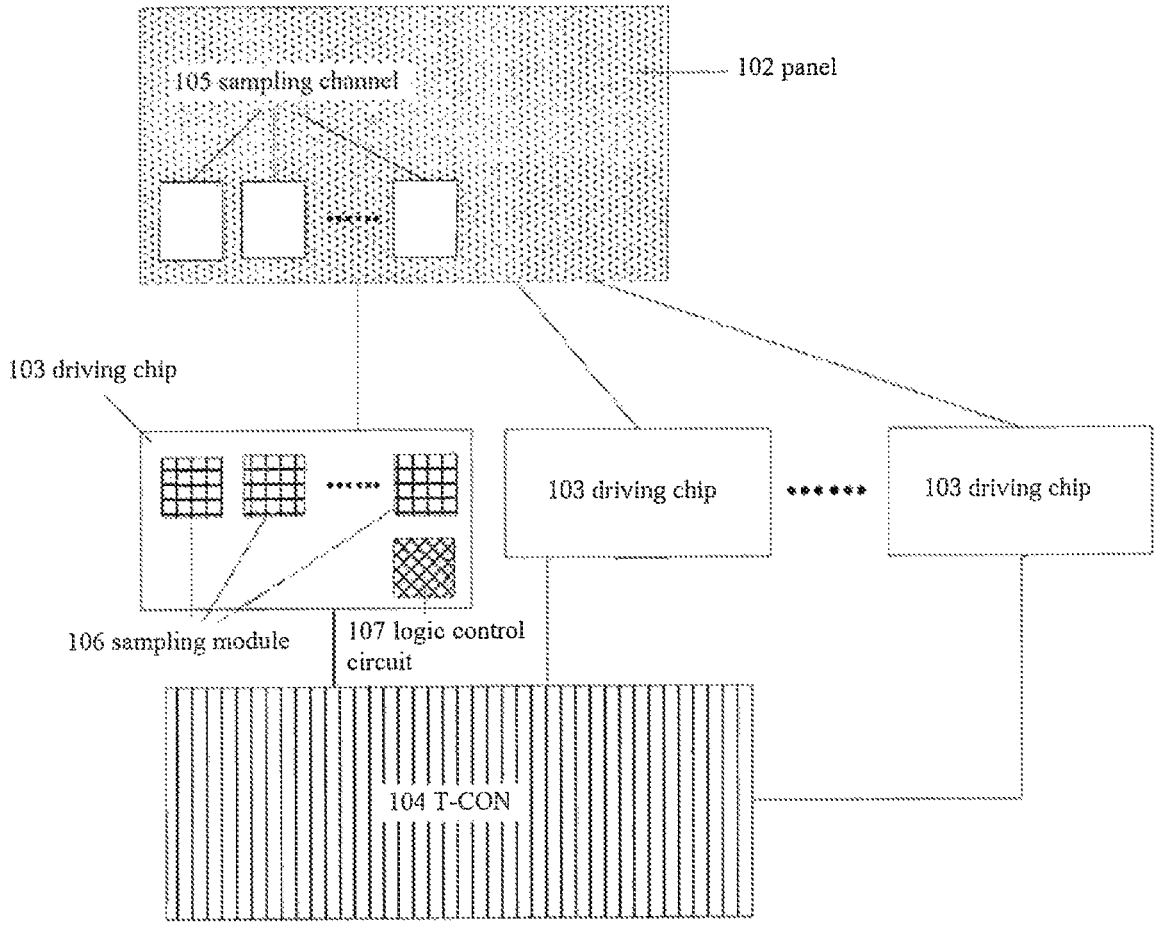
FIG. 1 is a schematic diagram of a sampling mode principle of a sampling method according to an embodiment of the present disclosure.

As shown in FIG. 1, in a sampling method provided by an embodiment of the present disclosure, a plurality of sampling channels (Channels, CH) 105 are disposed on a panel 102, and the sampling channels 105 are respectively connected to pixel units (not shown) on the display substrate to sample luminance information of the pixel units; a driving chip (Integrated Circuit IC) 103 is provided with a plurality of sampling modules (Sense) 106, each sampling module 106 is connected to the plurality of sampling channels 105 to acquire luminance information of the pixel units input by the sampling channel 105; the driving chip 103 is further provided with a logic control circuit 107 for outputting a control signal to control the sampling module 106 and/or the sampling channel 105 to be turned on; after all the sampling modules 106 complete sampling, the driving chip 103 outputs the acquired luminance information of the pixel units to the timing control module (Timing Controller, T-CON) 104, the T-CON 104 uses an algorithm preset in the T-CON 104 to calibrate the received luminance information of the pixel units, and output the calibrated luminance information to a pixel driving circuit (not shown) which is configured to adjust the luminance of the pixel units.

It should be noted that the driving chip (Integrated Circuit IC) 103 described in the embodiment of the present disclosure may be understood as a sampling chip, the logic control circuit 107 may be understood as a controller, and the controller may be various devices having a control sampling module and a sampling channel. The T-CON 104 can be understood as a processor, and the processor can be various devices having computing and storage computing functional structures.

In the following, as an example, the controller is a logic circuit, the processor is a timing control module, and the sampling device is a driving chip including a controller and a sampling module. It should be noted that, in the following, examples are given only to better explain the principle of the present disclosure, in which devices that represent controllers, processors, and sampling devices do not limit the disclosure.

Figure 2:
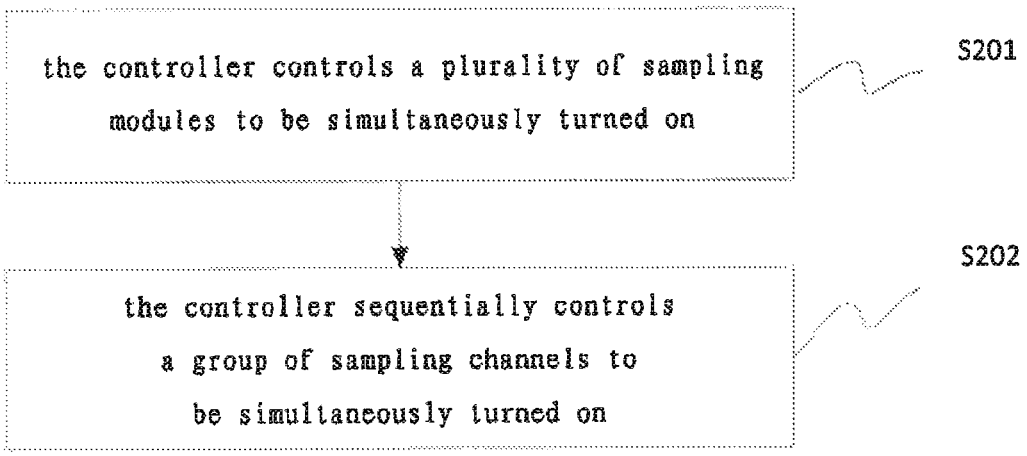
FIG. 2 is a schematic flowchart of a sampling mode of a sampling method according to an embodiment of the present disclosure.

On the controller side (that is, the logic control circuit side), as shown in FIG. 2, the embodiment of the present disclosure provides a sampling method, the method includes:

S201: the controller controls a plurality of sampling modules to be simultaneously turned on, so that a plurality of sampling modules controlled by the controller are capable of receiving and saving luminance information of the pixel units obtained through sampling of the sampling channel, wherein each sampling module is connected to a plurality of sampling channels, each sampling channel includes an input terminal and an output terminal, the input terminal is configured to sample luminance information of pixel units of a partial region on the display substrate, and an output terminal is configured to transmit the luminance information obtained by sampling to a sampling module connected to the sampling channel; the sampling module is configured to receive and save luminance information input by the sampling channel;

S202: the controller sequentially controls a group of sampling channels to be simultaneously turned on, so that the group of sampling channels simultaneously sample the luminance information, and transmit the sampled luminance information to respective sampling modules connected to the group of sampling channels through the output terminal of the group of sampling channels; wherein, the sampling channels that are turned on at the same time are a group of sampling channels, and respective sampling channels in each group of sampling channel are connected to different sampling modules respectively.

The illustration is made by taking the following example: the controller is a logic control circuit, the sampling device is a driving chip provided with a logic control circuit and a sampling module, and the processor is a timing control module. Specifically, for example, in the sampling method provided by the embodiment of the present disclosure, the panel 102 is provided with M sampling channels 105 for transmitting luminance information of the pixel unit, and the driving chip 103 is provided with N sampling modules 106 for receiving the luminance information of the pixel unit input by the sampling channel 105, where N≥1, M≥1, N≤M; then each sampling module 106 can sample at least two sampling channels 105. The number of the at least two sampling channels 105 sampled by each sampling module 106 may be the same or different, as long as the total number of the at least two sampling channels 105 sampled by N sampling module 106 is equal to M. For example the first sampling module samples 1~2 sampling channels, the second sampling module samples 3~7 sampling channels, . . . , the Nth sampling module samples M−5~M−2 sampling channels, the Nth sampling module samples M−1~M sampling channels. This example is only for an exemplary purpose. In the practice, any other suitable natural number may be selected.

In a preferred embodiment, each sampling module 106 can correspondingly sample L $$\left(L = \frac{M}{N}\right)$$

sampling channels 105 that is, the first sampling module samples 1~L sampling channels, the second sampling module samples L+1~2L sampling channels, . . . , the Nth sampling module samples M−L+1~M sampling channels; the driving chip 103 is provided with a logic control circuit 107, the logic control circuit 107 can output a control signal for controlling the operation of the sampling module 106 and the sampling channel 105. The signal for controlling the sampling module 106 can be, for example, a module control signal SW1, and the N sampling modules 106 correspond to N module control signals SW1[0]~SW1[N−1]; the signal for controlling the sampling channel 105 can be, for example, the channel control signal SW2, and each sampling module 106 correspondingly controls the L sampling channels 105, that is, the corresponding L channel control signals SW2[0]~SW2[L−1].

Figure 3:
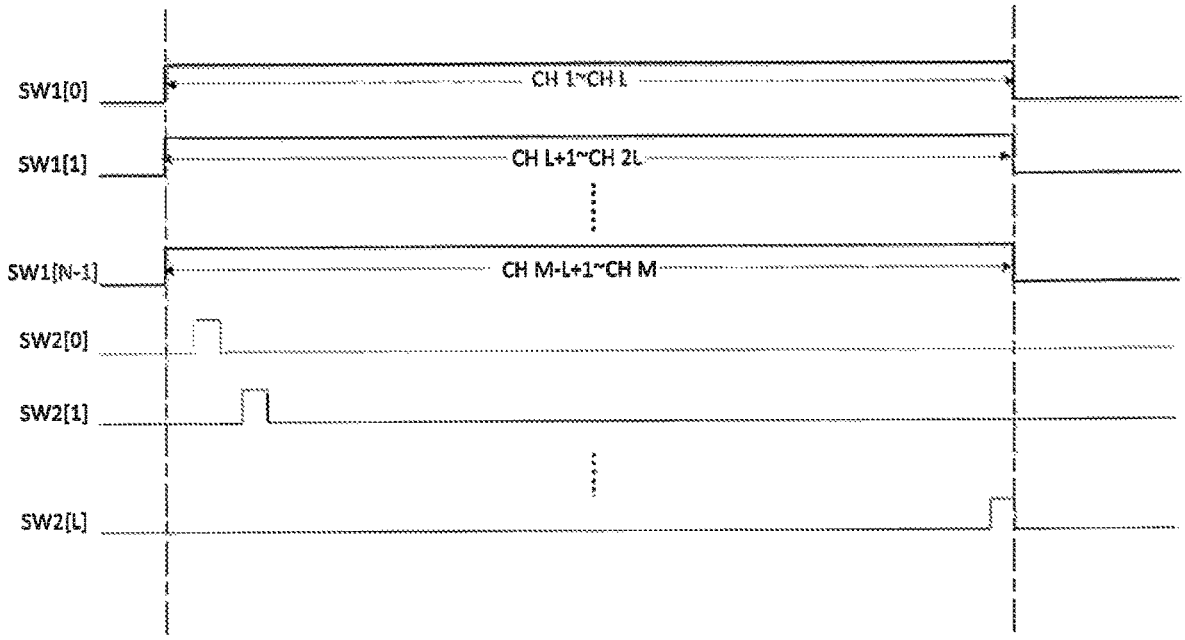
FIG. 3 is a sampling timing diagram of a sampling method according to an embodiment of the present disclosure.

Further, in a specific implementation, in the sampling method provided by the embodiment of the present disclosure, as shown in FIG. 3, the T-CON 104 outputs a system signal SMP to all the driving chips 103, to control all the driving chips 103 to start operation. All the logic control circuits 107 in the driving chip 103 simultaneously output N module control signals SW1[0]~SW1[N−1], wherein SW1[0] is configured to control the first sampling module 106 to be turned on, SW1[1] is configured to control the second sampling modules 106 to be turned on, and so on, SW1[N−1] is configured to control the Nth sampling module 106 to be turned on, thereby controlling the N sampling modules 106 to simultaneously start sampling, to acquire the luminance information of the pixel unit. That is, the N sampling modules 106 simultaneously starts sampling from the first rising edge timing of the module control signals SW1[0]~SW1[N−1] in FIG. 3.

Figure 4:
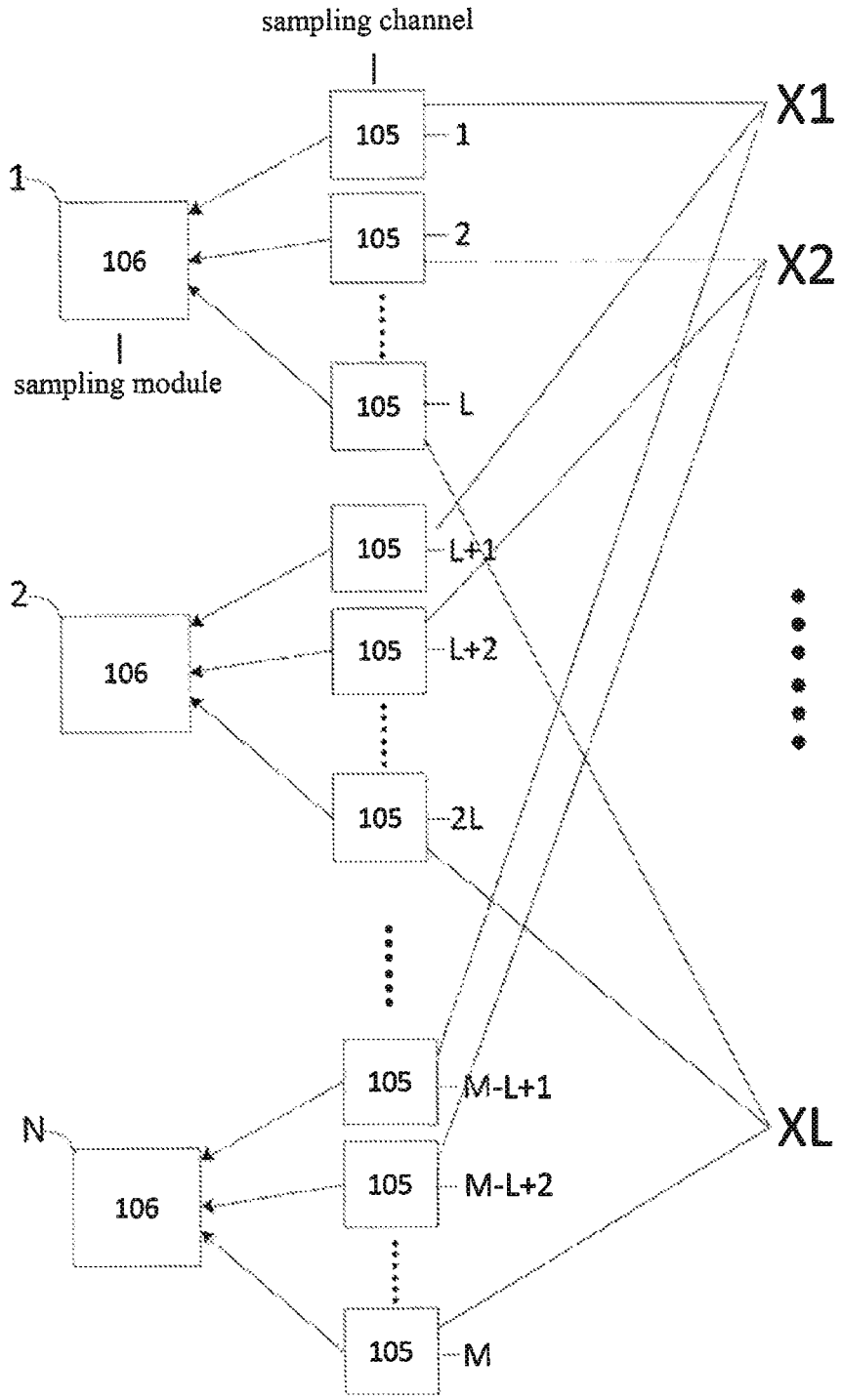
FIG. 4 is a schematic diagram of a sampling channel grouping of a sampling method according to an embodiment of the present disclosure.

The logic control circuit 107 sequentially outputs L channel control signals SW2[0]~SW2[L−1], and controls the N sampling modules 106 to simultaneously sample a sampling channel corresponding thereto, and finally makes each sampling module complete the sampling of the L sampling channels, where the N sampling modules simultaneously complete the sampling of the respective L sampling channels. Specifically, as shown in FIG. 4, the first sampling module 106 correspondingly samples 1~L sampling channels 105, the second sampling module 106 correspondingly sample L+1~2L sampling channels 105 . . . and so on, the Nth sampling modules 106 correspondingly sample M−L+1~M sampling channels 105; wherein the first sampling channel 105 of the sampling channels 105 corresponding to each sampling module 106 constitutes the first group of sampling channels X1, the second sampling channel 105 of the sampling channels 105 corresponding to each sampling module 106 constitutes the second group of sampling channel X2 . . . and so on, and the Lth sampling channel 105 of the sampling channels 105 corresponding to each sampling module 106 constitutes the Lth group of sampling channels XL; the logic control circuit 107 sequentially outputs the channel control signals SW2[0]~SW2[L−1] to control each group of sampling channels 105 to be simultaneously turned on. That is, when the logic control circuit 107 outputs the module control signal SW2[0] to the first group of sampling channels X1, each sampling module 106 simultaneously samples the first sampling channel 105 corresponding to the sampling module 106, and when the logic control circuit 107 outputs the module control signal SW2[1] to the second group of sampling channels X2, each sampling module 106 simultaneously samples the second sampling channel 105 corresponding to the sampling module 106, . . . and so on. When the logic control circuit 107 outputs the module control signal SW2[L−1] to the Lth group of sampling channels XL, each sampling module 106 simultaneously samples the Lth sampling channel 105 corresponding to the sampling module 106. In this way, the sampling module 106 completes a cycle of sampling on the last falling edge of the module control signals SW1[0]~SW1[N−1] in FIG. 3, that is, completes sampling of all sampling channels. In this way, by controlling all sampling modules to simultaneously start sampling of the sampling channels corresponding to the sampling modules respectively, sampling of M sampling channels is completed during the sampling of the L sampling channels performed by the sampling module, so that the time for sampling the luminance information of each pixel unit is greatly shortened, the speed of adjusting the luminance of the pixel unit is further increased, and the luminance uniformity of the display panel is improved.

Further, in a specific implementation, in the sampling method provided by the embodiment of the present disclosure, each driving chip 103 correspondingly acquires luminance information of pixel units in different regions of the display panel, and the sampling module 106 in each driving chip 103 corresponds to a row of pixel units in a region corresponding to the driving chip 103, and a group of sampling channels 105 sampled by each sampling module 106 correspondingly acquire luminance information of each pixel unit in the row of pixel units. That is, after the logic control circuit 107 in the driving chip 103 outputs a group of channel control signals SW2, the sampling module 106 completes sampling of the luminance information of the pixel unit of the region corresponding to the driving chip 103. Specifically, how to divide the region can be determined according to the actual requirement, which is not necessary to be limited here.

Further, in a specific implementation, in the sampling method provided by the embodiment of the present disclosure, before the sampling module starts sampling, the T-CON simultaneously outputs the system signal SMP to all the driving chips, and controls the driving chip to start operation.

Further, in a specific implementation, in the sampling method provided by the embodiment of the present disclosure, in the sampling mode, after the sampling of sampling channels corresponding to all sampling modules is completed, the T-CON may output an command signal TX_STB1 to the logic control circuit in the driving chip, the logic control circuit controls each sampling module to send the saved signals from the respective sampling channels to the T-CON. The signal of the sampling channel is the luminance information of the pixel unit obtained by sampling of the sampling channel which is saved by the sampling module, the luminance information is configured for adjusting the luminance of each pixel unit which corresponds to the sampling channel corresponding to the sampling module in the driving chip. If the display panel includes multiple driving chips, the first driving chip transmits the luminance information to the T-CON, and then outputs an output command signal TX_STB2 to the second driving chip, so that the second driving chip outputs the obtained luminance information of the pixel unit to the T-CON, and so on, until the last driving chip completes transmitting the acquired luminance information of the pixel unit to the T-CON. Specifically, the driving chip inputs the luminance information of D0~Dn bits to the T-CON through multiple pulse signals. How many bits will be occupied to transmit data can be designed according to requirement, which is not necessary to be limited here.

Further, in a specific implementation, in the sampling method provided by the embodiment of the present disclosure, the T-CON first outputs SMP to control all the driving chips to start operation, and then outputs the TX_STB1 to control the driving chip to transmit data to the T-CON. The time interval between outputting TX_STB1 and outputting SMP by the T-CON is greater than or equal to the sampling duration from the start of sampling to the completion of sampling by all sampling modules. For example, a sampling duration can be estimated according to the number of sampling channels, which is called the first duration. After T-CON outputs SMP to all chips, timing begins. After the first duration of the timing is greater than or equal to the sampling duration, the T-CON output TX_STB1, to control the driving chip to transmit to the T-CON the luminance information of the pixel unit acquired by the sampling module in the driving chip.

Further, in a specific implementation, in the sampling method provided by the embodiment of the present disclosure, the driving chip 103 can operate in two operation modes comprising a sampling mode and a calibration mode. Each driving chip 103 can be provided with an operation mode selection pin (PIN). Before the driving chip 103 starts operation, the T-CON 104 inputs an operating mode selection signal SEN-EN to the operating mode selection pin on the driving chip 103 for controlling whether the sampling mode or the calibration mode is selected by the driving chip 103. Specifically, when the operation mode selection signal SEN-EN received by the PIN on the driving chip 103 is at a high level (or a low level), that is, when the driving chip 103 receives the sampling mode selection signal SEN-EN1 sent by the T-CON 104, the driving chip 103 controls the sampling module 106 in the driving chip 103 to perform a sampling operation, that is, performs the above step S201, and controls the plurality of sampling modules 106 to be simultaneously turned on; when the operation mode selection signal SEN-EN received by the PIN on the driving chip 103 is at a low level (or a high level), that is, when the driving chip 103 receives the calibration mode selection signal SEN-E N2 sent by the T-CON 104, the driving chip 103 controls the sampling module 106 in the driving chip 103 to perform a calibration operation, and controls the plurality of sampling modules 106 to be sequentially turned on. Of course, the manner of selecting the sampling mode and the calibration mode for the driving chip 103 is not limited to the above. The manner can be designed as needed, as long as it is feasible in accordance with the principles of the present disclosure, and is not limited herein.

Due to the slight difference among the circuit components of each of sampling channel and sampling module in actual application, the parasitic parameters of each of sampling channel and sampling module are different, which may bring errors to the sampling result of the sampling module. That is, when the signals of the input sampling channels are the same, the same channel is sampled by different sampling modules, and different values may be returned; the same module samples different channels, and different values may be returned. Therefore, in order to eliminate the error, the sampling channel and the sampling module can be calibrated. When the driving chip 103 receives the calibration mode selection signal SEN-EN2 sent by the T-CON 104, the driving chip 103 performs actions in the calibration mode.

Figure 5:
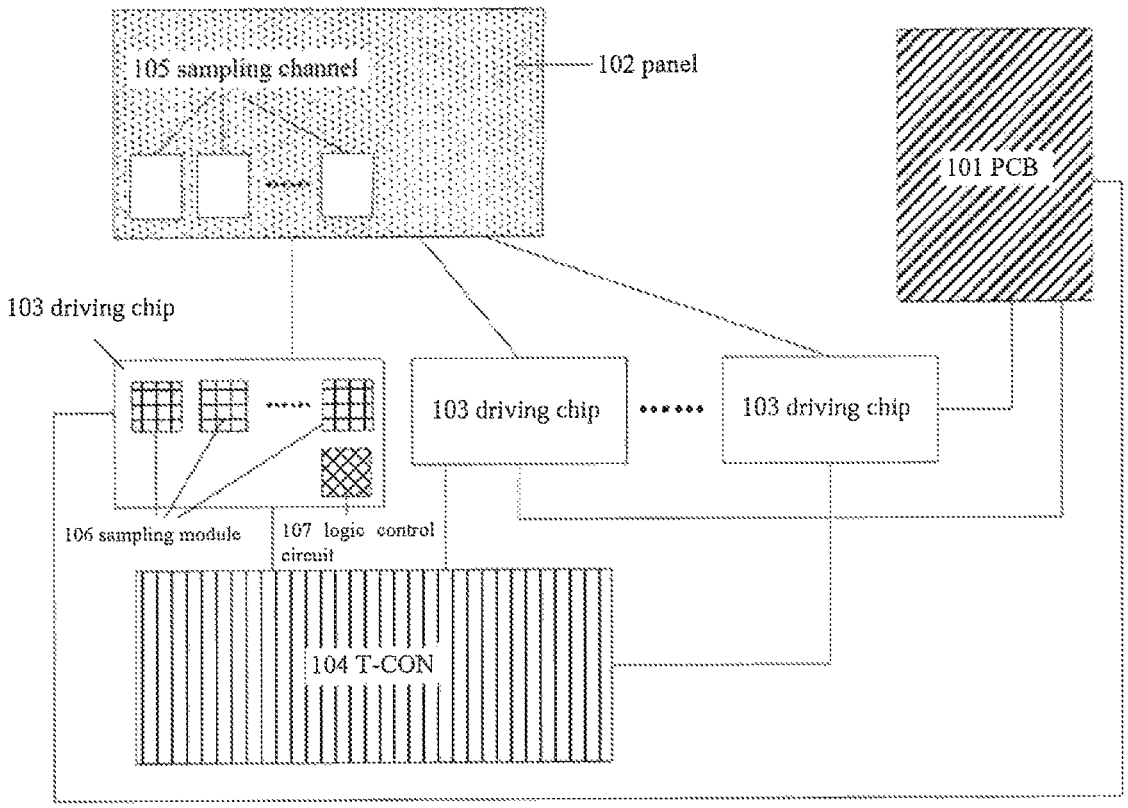
FIG. 5 is a schematic flowchart of a calibration mode of a sampling method according to an embodiment of the present disclosure.

Further, in the sampling method provided by the embodiment of the present disclosure, the method further includes a calibration mode. As shown in FIG. 5, the panel 102 is provided with a plurality of sampling channels 105, and the driving chip 103 is provided with a plurality of sampling modules 103 and a logic control circuit 107. The printed circuit board (Printed Circuit Board, PCB) 101 is provided with a calibration source, the calibration source is a constant standard signal, for example, a constant current or a constant voltage. All the driving chips 103 are connected to the PCB 101. When the calibration mode selection signal SEN-EN2 sent by the timing control module is received, the calibration source is input respectively as a standard signal to the sampling channels 105 corresponding to respective sampling modules 106 in the driving chip 103, so that the sampling modules 106 acquire the sampling module output signal respectively. After all the sampling modules 106 respectively perform sampling with the calibration source, the sampling modules 106 sequentially transmit the collected output signals of the output terminals of the respective sampling channels 105 to the T-CON 104.

Further, in a specific implementation, in the sampling method provided by the embodiment of the present disclosure, the input signals of the input terminals of the respective sampling channels are the same, which are all standard signals provided by the same calibration source. Specifically, only one calibration source is set in the display panel, that is, the same calibration source is used as a standard signal to input each sampling module and the sampling channel corresponding to the sampling module. By making the input signals of the input terminals of each sampling channel the same, the uniqueness of the calibration source is ensured, and the error of the sampling result due to the difference of the signals of the input sampling channel is eliminated, thereby further improving the reliability of the sampling result.

Figure 6:
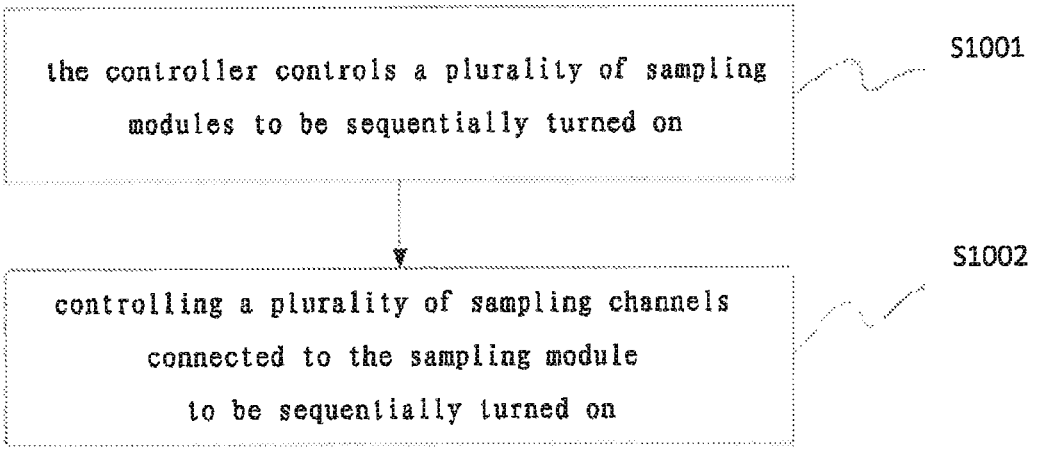
FIG. 6 is a schematic flowchart of a calibration mode of a sampling method according to an embodiment of the present disclosure.

Further, as shown in FIG. 6, in a specific implementation, in the sampling method provided by the embodiment of the present disclosure, the method further includes:

S1001: when the controller receives the calibration mode selection signal sent by the processor, the controller controls the plurality of sampling modules to be sequentially turned on, so that the plurality of sampling modules controlled by the controller are capable of receiving and saving the output signals of the output terminals of the sampling channel.

S1002: after controlling each sampling module to be turned on, the controller controls a plurality of sampling channels connected to the sampling module to be sequentially turned on, so that the input terminal of the sampling channel sequentially receives the signal input by the calibration source, and performs sampling on the calibration source; wherein the calibration source is configured to provide a standard signal to the input terminal of the sampling channel when the controller receives the calibration mode selection signal sent by the processor.

In the following, as an example, the controller is a logic control circuit, the sampling device is a driving chip provided with a logic control circuit and a sampling module, and the processor is a timing control module.

Specifically, in the sampling method provided by the embodiment of the present disclosure, as described above, M sampling channels are disposed on the panel for transmitting luminance information of the pixel unit, and N sampling modules are disposed on the driving chip for receiving the luminance information of the pixel unit input by the sampling channel, wherein $N \geq 1$, $M \geq 1$, $N \leq M$; then each sampling module 106 can sample at least two sampling channels 105. The number of the at least two sampling channels 105 sampled by each sampling module 106 may be the same or different, as long as the total number of the at least two sampling channels 105 sampled by N sampling module 106 is equal to M. For example, the first sampling module samples 1~2 sampling channels, the second sampling module samples 3~7 sampling channels, . . . , the Nth sampling module samples M−5~M−2 sampling channels, the Nth sampling module samples M−1~M sampling channels. This example is only for an exemplary purpose. In the practice, any other suitable natural number may be selected.

In a preferred embodiment, each sampling module 106 can correspondingly sample L (L=M/N) sampling channels, that is, the first sampling module samples 1~L sampling channels, the second sampling module samples L+1~2L sampling channels, . . . , the Nth sampling module samples M−L+1~M sampling channels; the driving chip is provided with a logic control circuit, the logic control circuit can output a control signal for controlling the operation of the sampling module and the sampling channel. The signal for controlling the sampling module can be, for example, a module control signal SW1, and the N sampling modules correspond to N module control signals SW1[0]~SW1[N−1]; the signal for controlling the sampling channel can be, for example, the channel control signal SW2, and each sampling module correspondingly controls the L sampling channels, that is, the corresponding L channel control signals SW2[0]~SW2[L−1].

Figure 7:
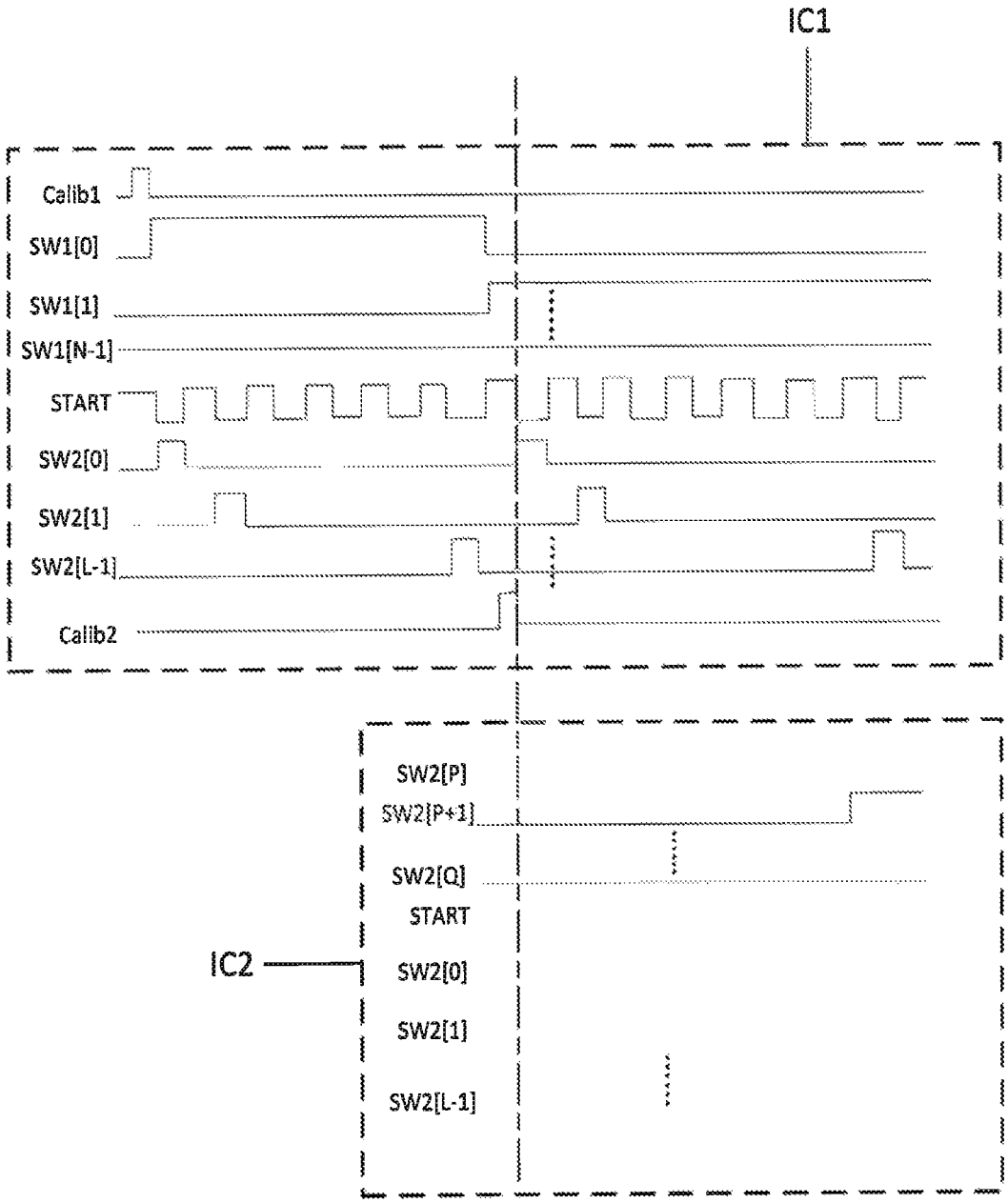
FIG. 7 is a sampling timing chart of a calibration mode of a sampling method according to an embodiment of the present disclosure.

Further, in a specific implementation, in the sampling method provided by the embodiment of the present disclosure, as shown in the IC1 part of the driving chip in FIG. 7, the driving chip IC1 is connected to the calibration source in the PCB, and the driving chip IC1 receives the calibration mode selection signal SEN-EN2 sent by the T-CON, T-CON outputs a cascade control signal calib1 to control the driving chip IC1 to start operation, and the logic control circuit in the driving chip IC1 turns on the module control signal SW1[0] to control the first sampling module to be turned on. The logic control circuit sequentially turns on L channel control signals SW2[0]~SW2[L−1], and sequentially controls the L sampling channels corresponding to the sampling module to be turned on, and the calibration source is sequentially input as a standard signal to the sampling channel to obtain an output signal of the output terminal of the sampling channel Specifically, when the logic control circuit in the driving chip IC1 outputs the module control signal SW2[0], the calibration source is input as the standard signal to the first sampling channel corresponding to the first sampling module, to obtain the output signal of the output terminal of the first sampling channel; when the logic control circuit outputs the module control signal SW2[1], the calibration source is input as a standard signal to the second sampling channel corresponding to the first sampling module, to obtain an output signal of the output terminal of the second sampling channel; . . . and so on, when the logic control circuit outputs the module control signal SW2[L−1], the calibration source is input as a standard signal to the Lth sampling channel corresponding to the first sampling module, to obtain an output signal of the output terminal of the Lth sampling channel; after the first sampling module completes sampling, the logic control circuit outputs a module control signal SW1[1], controlling the second sampling module to be turned on; the logic control circuit in the driving chip IC1 sequentially turns on the L channel control signals SW2[0]~SW2[L−1], and sequentially controls the L sampling channels corresponding to the second sampling module to be turned on. The calibration source is sequentially input as the standard signal to the sampling channel to obtain an output signal of the output terminal of the sampling channel. That is, when the logic control circuit sends the module control signal SW2[0], the calibration source is input as a standard signal to the (L+1)th sampling channel corresponding to the second sampling module, to obtain an output signal of the output terminal of the (L+1)th sampling channel; when the logic control circuit outputs the module control signal SW2[1], the calibration source is input as the standard signal to the (L+2)th sampling channel corresponding to the second sampling module, to obtain an output signal of the output terminal of the (L+2)th sampling channel, . . . and so on, when the logic control circuit outputs the module control signal SW2[L−1], the calibration source is input as a standard signal to the 2Lth sampling channel corresponding to the second sampling module, to obtain an output signal of the output terminal of the 2Lth sampling channel; after the second sampling module completes sampling, the logic control circuit outputs a module control signal SW1[2], controls the third sampling module to start sampling the calibration information of the calibration source, . . . and so on. Correspondingly, after the (N−1)th sampling module completes sampling, the logic control circuit in the driving chip IC1 outputs a module control signal SW1[N−1] to control the Nth sampling module to be turned on; the logic control circuit sequentially turns on L channel control signals SW2[0]~SW2[L−1], and sequentially controls the L sampling channels corresponding to the N sampling modules to be turned on, and the calibration source is sequentially input as the standard signal to the sampling channel, to obtain the output signal of the output terminal of the sampling channel. That is, when the logic control circuit outputs the module control signal SW2[0], the calibration source is input as the standard signal to the (M−L+1)th sampling channel corresponding to the Nth sampling module, to obtain the output signal of the output terminal of the (M−L+1)th sampling channel. When the logic control circuit outputs the module control signal SW2[1], the calibration source is input as the standard signal to the (M−L+2)th sampling channel corresponding to the Nth sampling module, to obtain the output signal of the output terminal of the (M−L+2)th sampling channel, . . . and so on. When the logic control circuit sends the module control signal SW2[L−1], the calibration source is input as the standard signal to the Mth sampling channel corresponding to the Nth sampling module, to obtain the output signal of the output terminal of the Mth sampling channel; after the Nth sampling module completes sampling, the output signal of the output terminal of each sampling channel is sent to the T-CON, so that the T-CON utilizes the output signals input by all sampling module for calculation, obtains a sampling mean value of the output signals, compares the output signals of the output terminals of respective sampling channels corresponding to the sampling module with the sampling mean value, and obtains calibration values of the sampling channels corresponding to the sampling module according to the comparison result, and stores the calibration values in the T-CON.

Further, in a specific implementation, in the sampling method provided by the embodiment of the present disclosure, after the logic control circuit determines that the involved driving chip completes sampling, the logic control circuit sends a cascade control signal to a logic control circuit in the next driving chip cascaded with the driving chip to which the logic control circuit belongs, so that the logic control circuit in the next driving chip controls a plurality of sampling modules in the next driving chip to be sequentially turned on. Specifically, the cascade control signal calib1 output by the T-CON may control the first driving chip start operation, the logic circuit in the driving chip turns on the module control signal SW1, and the T-CON controls the first driving chip to start the calibration operation. After the subsequent driving chips are calibrated by the previous driving chip, a cascade control signal calib2 is output to the next driving chip cascaded with the driving chip to control the next driving chip to start the calibration operation. Further, in a specific implementation, in the sampling method provided by the embodiment of the present disclosure, as shown in FIG. 7, if the display panel includes a plurality of driving chips (for example, the driving chip IC1 and the driving chip IC2), after the first chip IC1 completes the sampling of the calibration information, the driving chip IC1 sends a cascade control signal calib2 to the next driving chip IC2, and controls the next driving chip to repeat the above steps at the time of the first falling edge of the calib2 (the intersection of the vertical dotted line and the cascade signal calib2 in FIG. 7), and the calibration operation is completed for all the sampling channels P~Q (P≥1, Q≥1) in the driving chip IC2.

Figure 8:
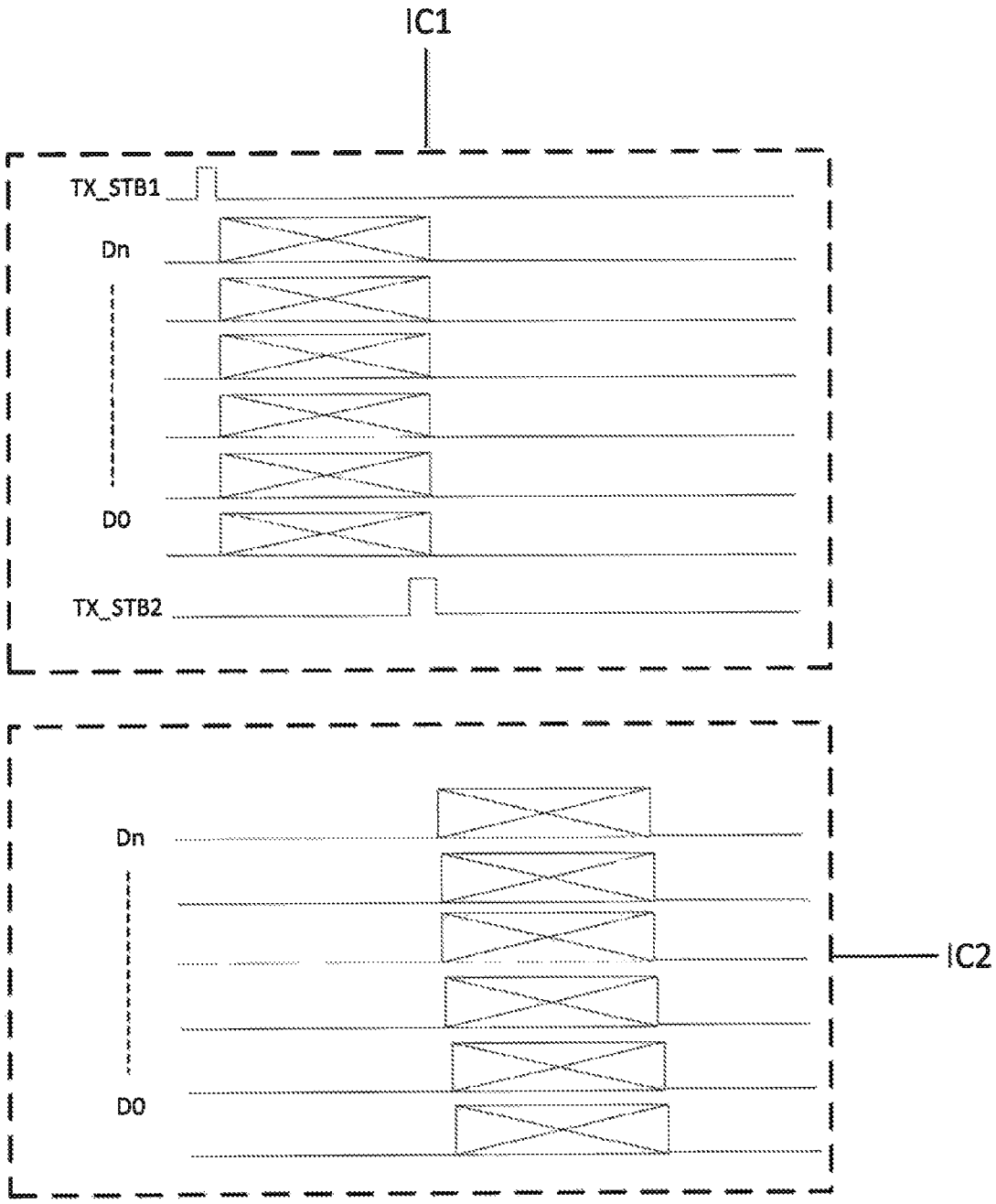
FIG. 8 is a timing diagram of transmitting signals in a calibration mode of a sampling method according to an embodiment of the present disclosure.

Further, in a specific implementation, in the sampling method provided by the embodiment of the present disclosure, after sampling of sampling channels corresponding to all sampling modules in the calibration mode are completed, the T-CON may output an output command signal TX_STB1 to the logic circuit in the driving chip, the logic control circuit controls each sampling module to send the saved signals from the respective sampling channels to the T-CON. The signal of the sampling channel is the output signal of the output terminal of each sampling channel held by the sampling module, which is configured to calibrate respective sampling modules and sampling channels to eliminate errors. Specifically, the driving chip inputs the output signals of the D0~Dn bits through multiple pulse signals to the T-CON; if the display panel includes multiple driving chips, for example, referring to FIG. 8, in the calibration mode, after all the sampling modules in the driving chip IC1 and the driving chip IC2 have collected the output signals of the output terminals of the respective sampling channels, the T-CON outputs an output command signal TX_STB1 to the driving chip IC1, to control the driving chip IC1 to input the output signals of the D0~Dn bits to the T-CON through a plurality of pulse signals; after the driving chip IC1 completes transmission the output signals to the T-CON, the output command signal TX_STB2 is output to the driving chip IC2, so that the driving chip IC2 inputs the output signals of the D0~Dn bits to the T-CON through a plurality of pulse signals, and how many bits are occupied to transmit the data can be designed according to requirements, which is no limited here.

Further, in a specific implementation, in the sampling method provided by the embodiment of the present disclosure, during the entire sampling period in which the driving chip operates in the sampling mode or the calibration mode, the logic control circuit in the driving chip continuously outputs a reset control signal START. The levels of the reset control signal START are opposite to the levels of the channel control signal SW2, and they are configured to reset the sampling module, that is, when START is at a low level, and SW2 is at a high level, the sampling module starts sampling the first sampling channel at the falling edge of START and the rising edge of SW2. When SW2 is at the falling edge, the sampling module completes sampling of the sampling channel. At this time, the START outputs the rising edge, to reset the sampling module and prepare for the next sampling.

Further, in a specific implementation, in the sampling method provided by the embodiment of the present disclosure, the plurality of sampling modules may be sampling modules in the same chip, or may be sampling modules in different chips. As shown in FIG. 1, a plurality of driving chips 103 may be included in the display panel. Each of the driving chips 103 may be provided with a sampling module 106. The sampling module 106 controlled by the module control signal SW1 may be disposed in the same driving chip 103 or disposed in the different driving chips 103. The details can be specifically designed according to the needs of actual implementation, which is not limited herein.

The illustration is made by taking the following example.

Embodiment 1

Figure 9:
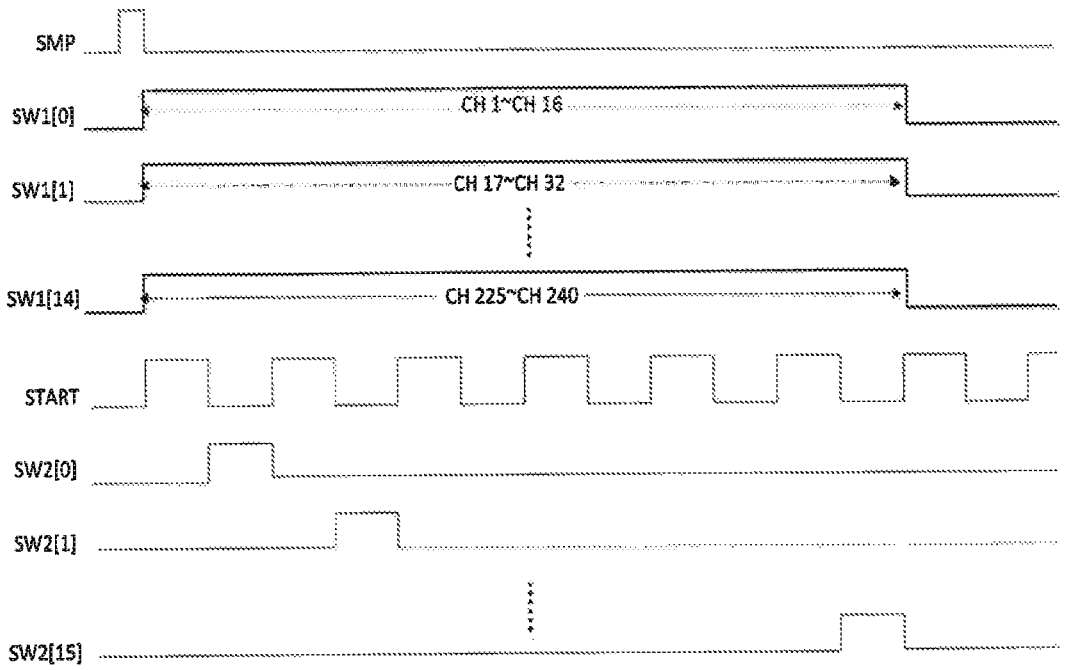
FIG. 9 is a sampling timing diagram of a single chip in a sampling method according to an embodiment of the present disclosure.

As shown in FIG. 9, all sampling modules are disposed in the same driving chip.

For example, the display panel includes a T-CON and a driving chip. The driving chip is provided with 15 sampling modules and a panel. The panel is provided with 240 sampling channels, that is, each sampling module correspondingly samples 16 sampling channels.

Figure 10:
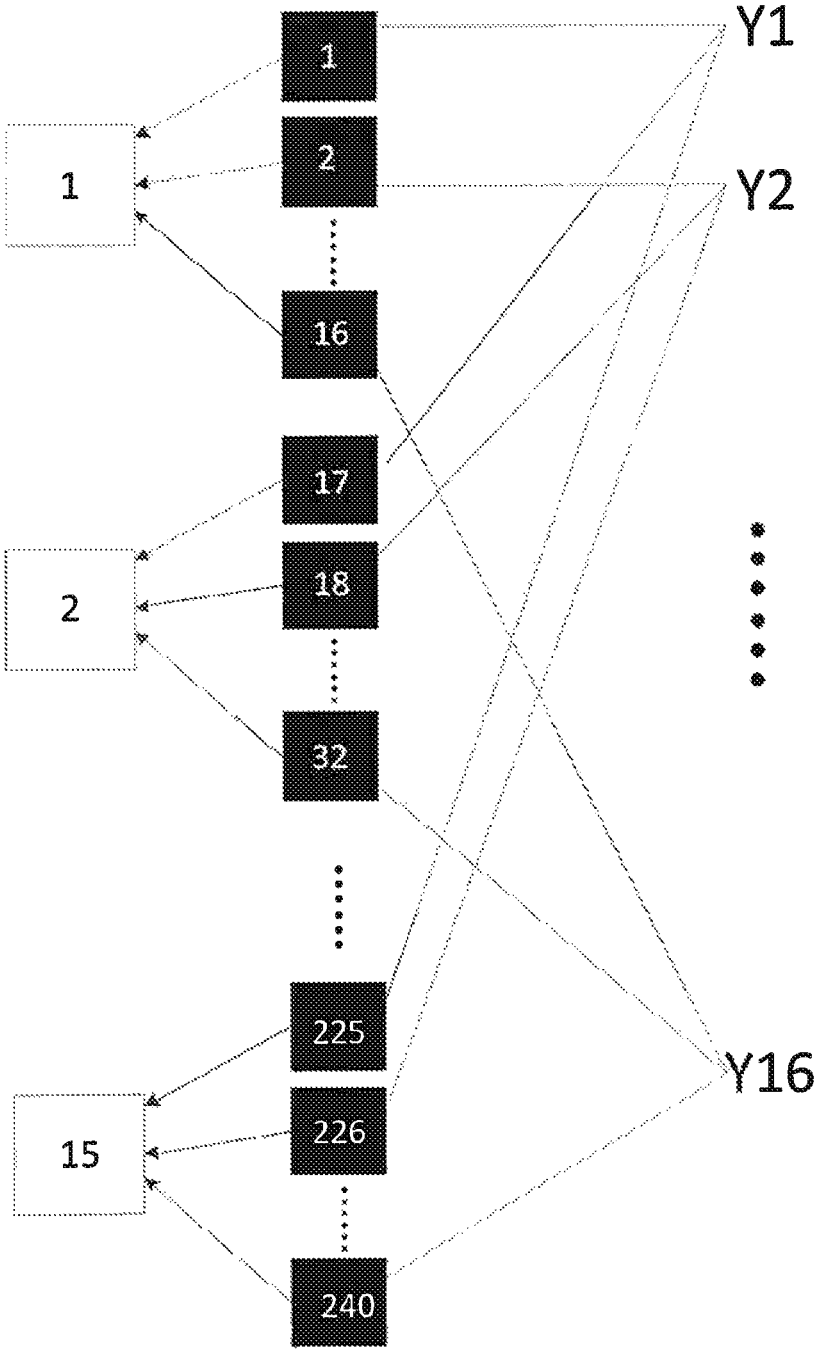
FIG. 10 is a schematic diagram of sampling channel grouping in a single-chip sampling method according to an embodiment of the present disclosure.

T-CON outputs the sampling mode selection signal SEN-EN1 to the operation mode selection pin on the driving chip, selects the driving chip to perform the sampling action; T-CON outputs the system signal SMP to the driving chip to control the driving chip to start operation, and the logic control circuit in the driving chip turns on the module control signals SW1[0]~SW1[14] corresponding to each sampling module, wherein SW1[0] is configured to control the first sampling module to be turned on, and SW1[1] is configured to control the second sampling module to be turned on, . . . and so on, SW1[14] is configured to control the 15th sampling module to be turned on, thereby controlling the 1st~15th sampling modules to start sampling at the same time. The logic control circuit sequentially outputs 16 channel control signals SW2[0]~SW2[15], each channel control signal is configured to control a group of sampling channels to be simultaneously turned on, thereby controlling 15 sampling modules simultaneously sampling 16 sampling channels corresponding to the sampling module respectively, to obtain luminance information of the pixel unit. Specifically, as shown in FIG. 10, the white squares in FIG. 10 indicate respective sampling modules, the numbers in the white squares indicate the numbers of the sampling modules among the 1st~15th sampling modules, and the black squares indicate respective sampling channels, the numbers in the black squares indicate the numbers of the sampling channels in the 1st~240th sampling channels. The first sampling module correspondingly samples the 1st to 16th sampling channels, the second sampling module correspondingly samples the sampling 17th to 32th sampling channels . . . and so on, and the 15th sampling module correspondingly samples the 225th to 240th sampling channels. Wherein the first sampling channel in the sampling channels corresponding to respective sampling modules constitutes the first group of sampling channels Y1, the second sampling channel in the sampling channels corresponding to respective sampling modules constitutes the second group of sampling channel Y2 . . . and so on, and the 16th sampling channel in the sampling channels corresponding to respective sampling modules constitutes the 16th group of sampling channel Y16. The logic control circuit sequentially outputs the channel control signals SW2[0]~SW2[15] to control each group of sampling channels to be simultaneously turned on. That is, when the logic control circuit outputs the module control signal SW2[0] to the first group of sampling channel Y1, each sampling module simultaneously samples the first sampling channel corresponding to the sampling module, and when the logic control circuit outputs the module control signal SW2[1] to the second group sampling channel Y2, each sampling module simultaneously samples the second sampling channel corresponding to the sampling module, . . . and so on. When the logic control circuit outputs the module control signal SW2[15] to the 16th sampling channel Y16, each sampling module simultaneously samples the 16th sampling channel corresponding to the sampling module. In this way, 15 sampling modules complete sampling of all sampling channels. Thus, by controlling all sampling modules simultaneously samples the sampling channels corresponding to the sampling modules, during the sampling modules samples 16 sampling channels, sampling of 240 sampling channels is completed, which greatly shortens the sampling time of the luminance information of each pixel unit, thereby improving the speed of adjusting the luminance of the pixel unit and improving the luminance uniformity of the display panel.

Figure 11:
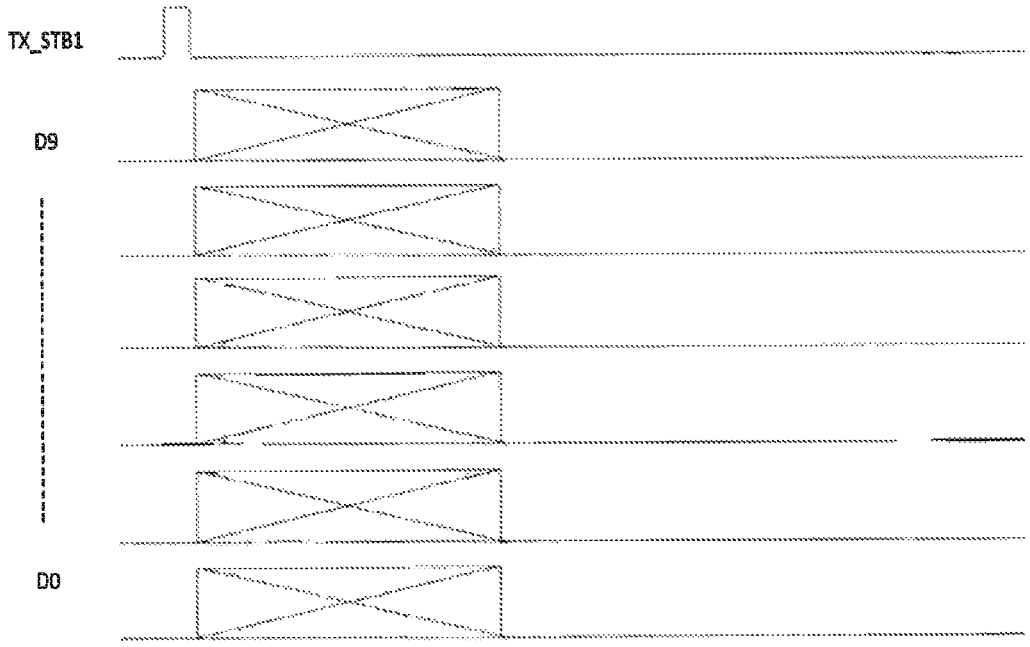
FIG. 11 is a timing diagram of transmission signal in a single-chip sampling method according to an embodiment of the present disclosure.

As shown in FIG. 11, after the sampling of the sampling channels corresponding to the sampling modules in the driving chip is completed, the T-CON outputs an output command signal TX_STB1 to the logic control circuit in the driving chip, and the logic control circuit controls the sampling module to transmit to the T-CON the saved luminance information of the pixel unit, the driving chip inputs the luminance information of the D0~Dn bits to the T-CON through a plurality of pulse signals, and the luminance information is configured for adjusting the luminance of respective pixel units corresponding to the driving chip.

The time interval at which the T-CON outputs the SMP and outputs TX_STB1 to the driving chip is greater than or equal to the sampling duration (or the first duration) during which sampling of the 16 sampling channels is completed.

Wherein, during the entire sampling period, the logic control circuit in the driving chip continuously outputs a reset control signal START. The level of the reset control signal START is opposite to the level of the channel control signal SW2, and they are configured for resetting the sampling module. That is, When START is low, SW2 is high, the sampling module starts sampling the first sampling channel at the falling edge of START and the rising edge of SW2. When SW2 is at the falling edge, the sampling module completes sampling of the sampling channel. At this time, START output a rising edge to reset the sampling module, and prepare for the next sampling.

Embodiment 2

Figure 12:
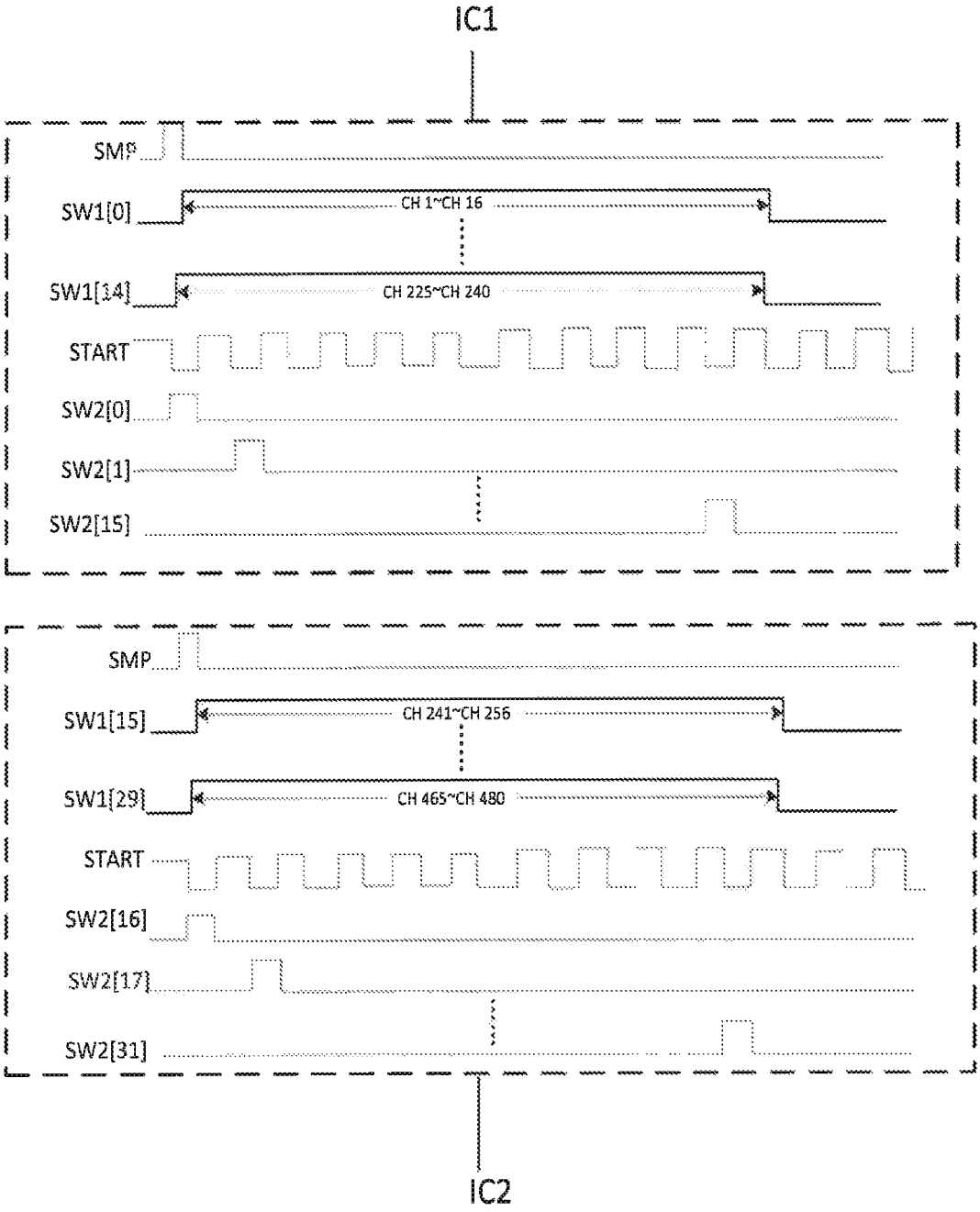
FIG. 12 is a sampling timing diagram in a multi-chip sampling method according to an embodiment of the present disclosure.

As shown in FIG. 12, respective sampling modules are disposed in different driving chips.

Here is an example of a display panel that includes two driving chips:

The display panel includes a T-CON, two driving chips (drive chip IC1 and driving chip IC2), each of which is provided with 15 sampling modules and a panel. The panel is provided with 480 sampling channels, that is, each sampling module correspondingly samples 16 sampling channels.

Figure 13A:
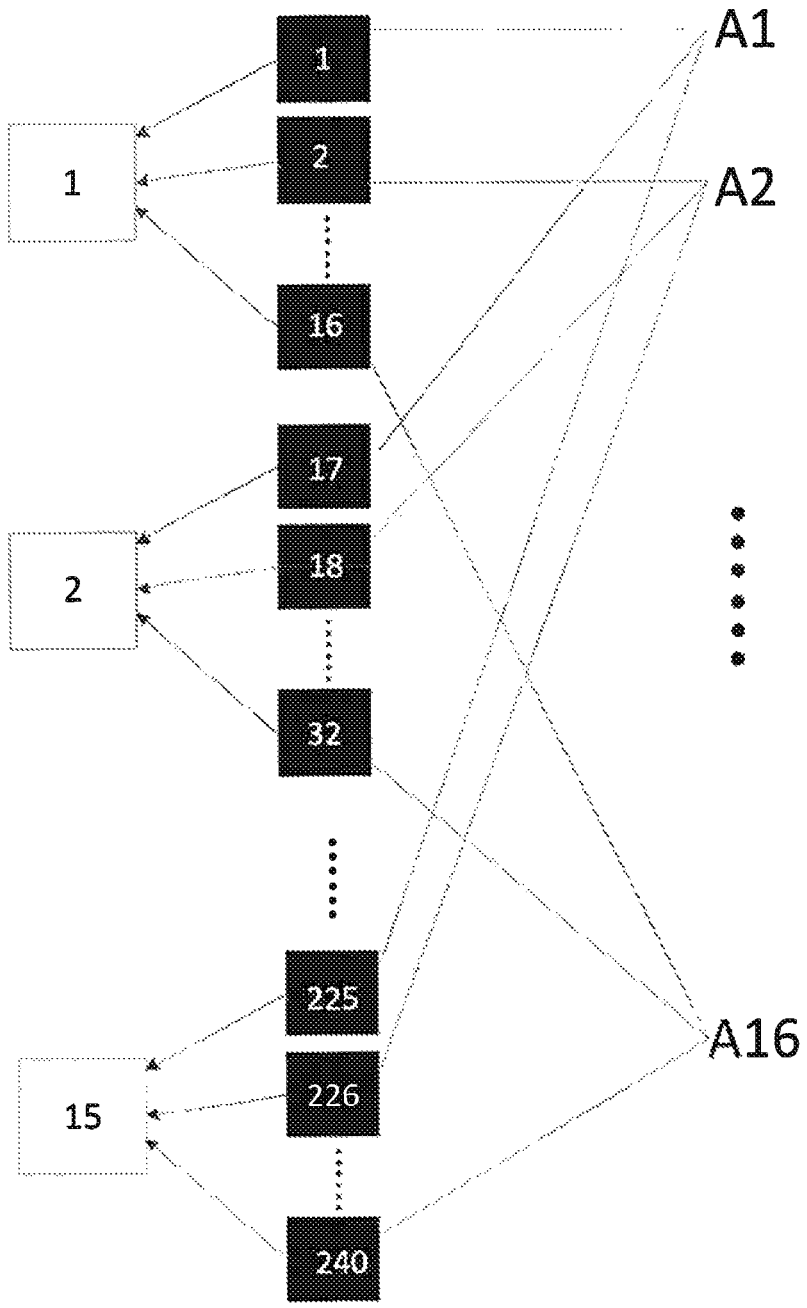
FIG. 13A is a schematic diagram of sample grouping in a multi-chip sampling method according to an embodiment of the present disclosure.
Figure 13B:
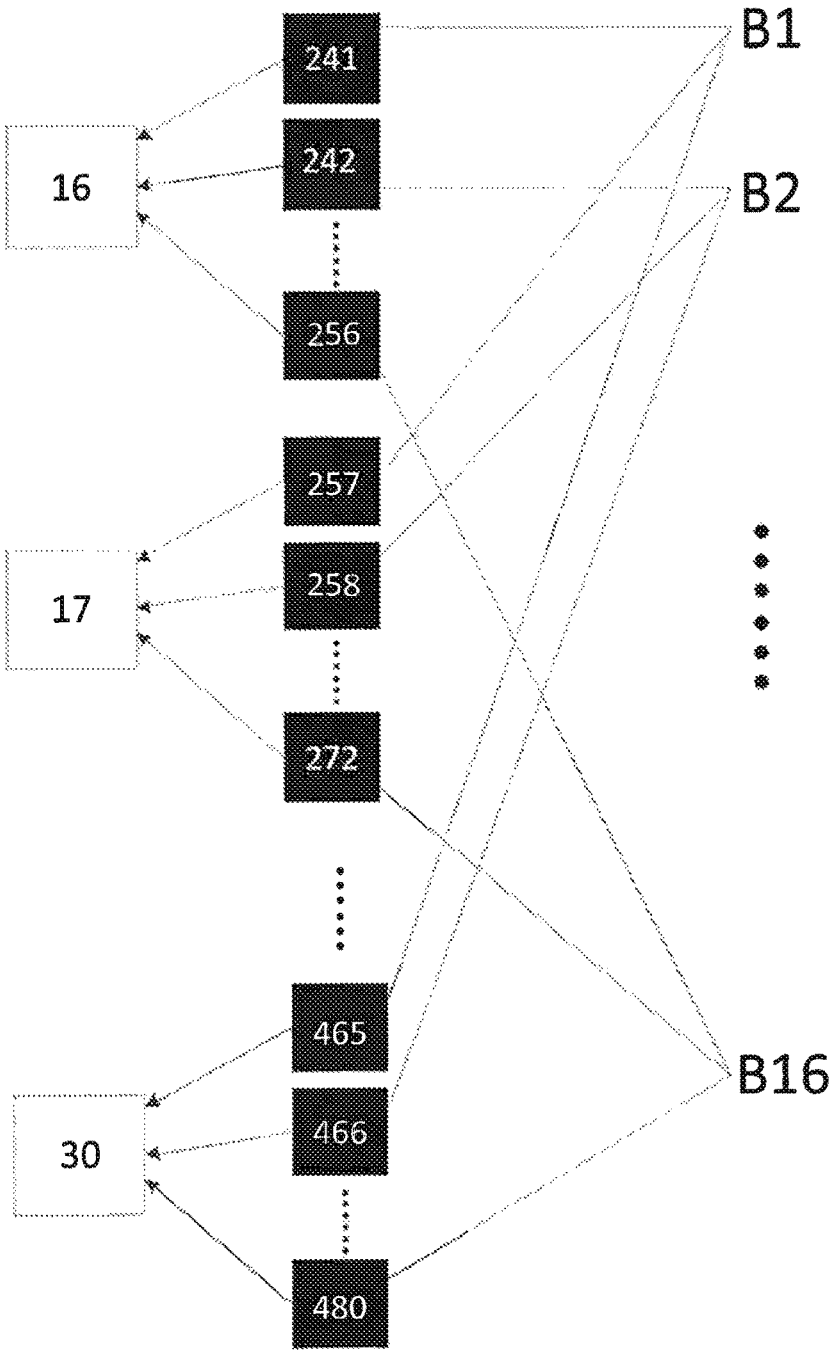
FIG. 13B is a second schematic diagram of sample grouping in a multi-chip sampling method according to an embodiment of the present disclosure.

The T-CON outputs the sampling mode selection signal SEN-EN1 to the operation mode selection pin on the driving chip IC1 and the driving chip IC2, selects the driving chip IC1 and the driving chip IC2 to perform the sampling action; T-CON outputs the system signal SMP to the two driving chips, to control these two driving chips to start operation. The logic control circuit in the two driving chips turns on the module control signals SW1[0]~SW1[29] corresponding to each sampling module in the driving chip, wherein SW1[0] is configured to control the first sampling module to be turned on, SW1[1] is configured to control the second sampling module 106 to be turned on, . . . and so on, and SW1[14] is configured to control the 15th sampling module to be turned on, thereby controlling sampling modules 1~15 in the driving chip IC1 start sampling at the same time. SW1[15] is configured to control the 16th sampling module to be turned on, SW1[16] is configured to control the 17th sampling module to be turned on, . . . and so on, SW1[29] is configured to control the 30th sampling module to be turned on, thereby controlling the sampling modules 16~30 in the driving chip IC2 to start sampling at the same time. The logic control circuit in the driving chip IC1 sequentially outputs 16 channel control signals SW2[0]~SW2[15], each channel control signal is configured to control a group of sampling channels to be simultaneously turned on, thereby controlling the sampling modules 1~15 in the driving chip IC1 to simultaneously sample the 16 sampling channels corresponding to the sampling module respectively, and the logic control circuit in the driving chip IC2 sequentially outputs the channel control signal SW2[16]~SW2[31], each channel control signal is configured to control a group of sampling channels to be turned on at the same time, thereby controlling the sampling modules 16~30 in the driving chip IC2 simultaneously sampling the 16 sampling channels corresponding to the sampling module respectively, to obtain the luminance information of the unit pixels. Specifically, as shown in FIG. 13*a*, the white squares in the figure indicate respective sampling modules, the numbers in the white squares indicate the numbers of the sampling modules in the sampling modules 1~15, and the black squares indicate respective sampling channels, the numbers in the block squares indicate the numbers of the sampling channels in the sampling channel 1~240. The sampling module 1 in the driving chip IC1 correspondingly samples the sampling channel 1~16, the sampling module 2 correspondingly samples the sampling channel 17~32 . . . and so on, the sampling module 15 correspondingly samples the sampling channels 225~240; wherein the first sampling channel in the sampling channels corresponding to each sampling module constitutes the first group of sampling channels A1, the second sampling channel in the sampling channels corresponding to each sampling module constitutes the second group of sampling channels A2 . . . and so on, and the 16th sampling channel in the sampling channels corresponding to each sampling module constitutes the $16^{th}$ group of sampling channels A16. The logic control circuit sequentially outputs channel control signals SW2[0]~SW2[5] to control each group of sampling channels to be simultaneously turned on, that is, when the logic control circuit output the module control signal SW2[0] to the first group sampling channels A1, each sampling module simultaneously samples the first sampling channel corresponding to the sampling module, and when the logic control circuit outputs the module control signal SW2[1] to the second group of sampling channels A2, each sampling module simultaneously samples the second sampling channel corresponding to the sampling module, . . . and so on, when the logic control circuit 107 outputs the module control signal SW2[15] to the 16th group of sampling channels A16, each sampling module correspondingly samples the 16th sampling channel corresponding to the sampling module. Similarly, as shown in FIG. 13*b*, the white squares in the figure indicate respective sampling modules, and the numbers in the white squares indicate numbers of the sampling modules among the sampling modules 16-30, the black squares indicate respective sampling channels, numbers in the black squares indicate numbers of the sampling channels in the sampling channels 241~480. The sampling module 16 in the driving chip IC2 correspondingly samples the sampling channel 241~256, and the sampling module 14 correspondingly samples the sampling channels 257~272, . . . and so on, the sampling module 30 correspondingly samples the sampling channels 465~480. Wherein, the first sampling channel in the sampling channels corresponding to respective sampling modules constitutes the first group of sampling channels B1, the second sampling channel in the sampling channels corresponding to respective sampling modules constitutes the second group of sampling channel B2 . . . and so on, and the 16th sampling channel in the sampling channels corresponding to respective sampling modules constitutes the 16th group of sampling channel B16. The logic control circuit sequentially outputs the channel control signals SW2[0]~SW2[15] to control each group of sampling channels to be simultaneously turned on. That is, when the logic control circuit outputs the module control signal SW2[0] to the first group of sampling channel B1, each sampling module simultaneously samples the first sampling channel corresponding to the sampling module, and when the logic control circuit outputs the module control signal SW2[1] to the second group sampling channel Y2, each sampling module simultaneously samples the second sampling channel corresponding to the sampling module, . . . and so on, when the logic control circuit outputs the module control signal SW2[15] to the 16th sampling channel Y16, each sampling module simultaneously samples the 16th sampling channel corresponding to the sampling module. In this way, by controlling all sampling modules simultaneously samples the sampling channels corresponding to the sampling modules, during the sampling modules samples 16 sampling channels, sampling of 240 sampling channels is completed, which greatly shortens the sampling time of the luminance information of each pixel unit, thereby improving the speed of adjusting the luminance of the pixel unit and improving the luminance uniformity of the display panel.

Figure 14:
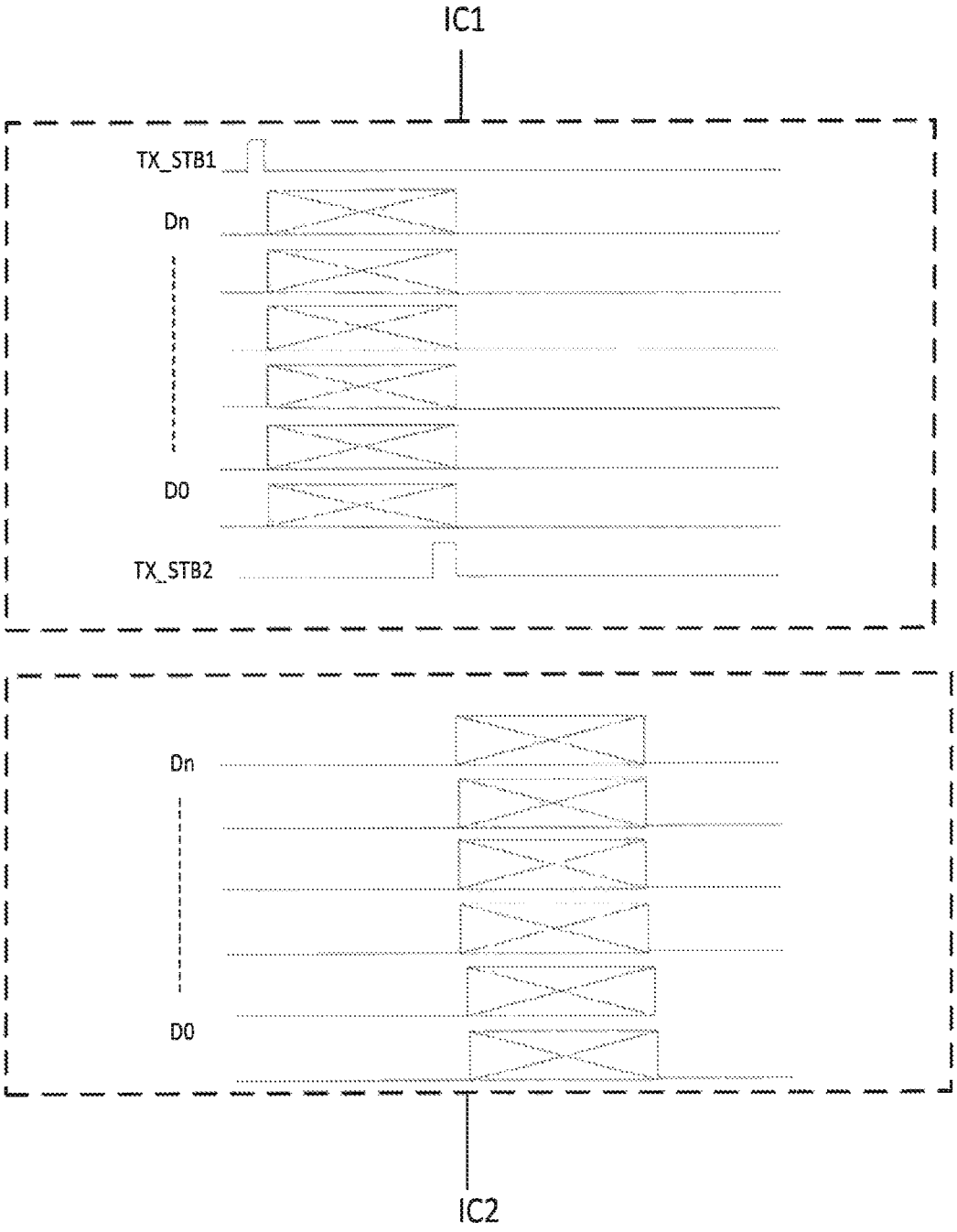
FIG. 14 is a timing diagram of a sampling mode transmission signal in a multi-chip sampling method according to an embodiment of the present disclosure.

As shown in FIG. 14, after sampling of the sampling channels corresponding to all the sampling modules is completed, the T-CON outputs an output command signal TX_STB1 to the logic control circuit in the driving chip IC1, and the logic control circuit controls the sampling module to transmit the saved luminance information pixel unit to the T-CON. The driving chip inputs the luminance information of the D0~Dn bits to the T-CON through a plurality of pulse signals. After the driving chip IC1 transmits the luminance information to the T-CON, the driving chip IC1 outputs the output command signal TX_STB2 to the driving chip IC2, so that the driving chip IC2 transmits the acquired luminance information of the pixel unit to the T-CON, and the driving chip inputs the luminance information of the D0-~Dn bits to the T-CON through a plurality of pulse signals, and the luminance information is configured for adjusting the luminance of respective pixel units. The driving chip IC1 and the driving chip IC2 correspond to regions of different pixel units on the display panel.

The time interval at which the T-CON outputs SMP and outputs TX_STB1 to the two driving chips is greater than or equal to the sampling duration (or the first duration) during which sampling of the 16 sampling channels is completed.

Wherein, during the entire sampling period, the logic control circuits in the driving chip IC1 and the driving chip IC2 continuously output a reset control signal START. The level of the reset control signal START is opposite to the level of the channel control signal SW2, and they are configured for resetting the sampling module. That is, When START is low and SW2 is high, the sampling module starts sampling the first sampling channel at the falling edge of START and the rising edge of SW2. When SW2 is at the falling edge, the sampling module completes sampling of the sampling channel. At this time, START output a rising edge to reset the sampling module, and prepare for the next sampling.

Figure 15:
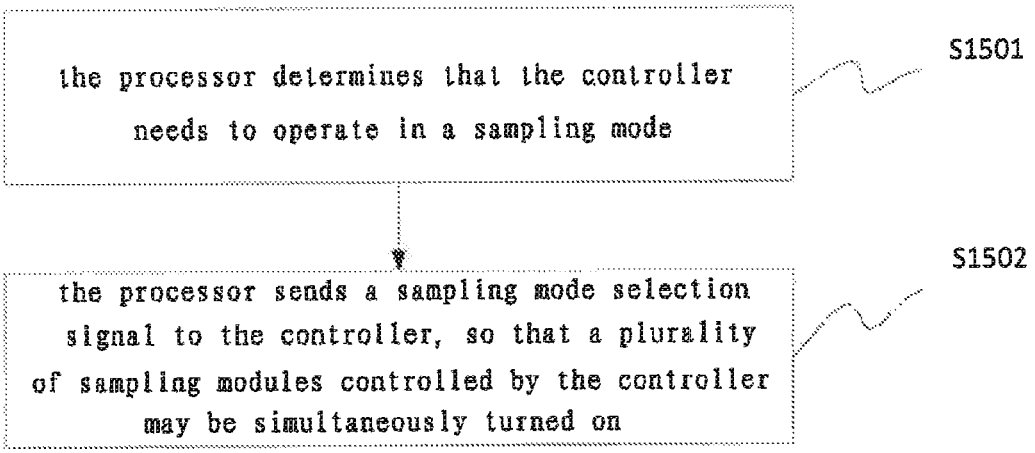
FIG. 15 is a schematic flowchart diagram of a sampling control method according to an embodiment of the present disclosure.

Correspondingly, on the processor side (i.e., the timing control module side), the embodiment of the present disclosure provides a sampling control method, as shown in FIG. 15, the method includes:

S1501: The processor determines that the controller needs to operate in a sampling mode;

S1502: The processor sends a sampling mode selection signal to the controller, so that the controller controls the plurality of sampling modules to be simultaneously turned on. Thus, the plurality of sampling modules controlled by the controller are capable of receiving and saving the luminance information of the pixel unit obtained through sampling of the sampling channel; wherein each sampling module is connected to the plurality of sampling channels, each sampling channel includes an input terminal and an output terminal. The input terminal is configured to sample luminance information of pixel unit of a partial region in the display substrate. The output terminal is configured to transmit the sampled luminance information to a sampling module connected to the sampling channel. The sampling module is configured to receive and save luminance information input by the sampling channel. And, the controller is made to sequentially control a group of sampling channels to be simultaneously turned on, the group of sampling channels is made to simultaneously sample the luminance information, and the sampled luminance information is transmitted to respective sampling modules connected to the group of sampling channels through the output terminal of the group of sampling modules. Wherein, the sampling modules turned on at the same time belong to a group of sampling channels, respective sampling channels in each group of sampling channels are connect to different sampling modules. Further, in a specific implementation, in the sampling control method provided by the embodiment of the present disclosure, the method further includes:

The processor determines that the controller is required to operate in the calibration mode;

The processor sends a calibration mode selection signal to the controller, so that the controller controls the plurality of sampling modules to be sequentially turned on. Thus, the plurality of sampling modules controlled by the controller are capable of receiving and saving the output signal from the output terminal of the sampling channel. Wherein, after the controller controlling each sampling module to be turned on, the controller controls a plurality of sampling channels connected to the sampling module to be sequentially turned on, so that the input terminal of the sampling channel sequentially receives the input signal of the calibration source, and the calibration source is sampled. Wherein, the calibration source is configured to provide a standard signal to the input terminal of the sampling channel, when the controller receives the calibration mode selection signal sent by the processor.

Further, in a specific implementation, in the sampling control method provided by the embodiment of the present disclosure, the method further includes:

The processor acquires sampling results from respective sampling channels which are saved in the sampling module controlled by the controller after the first time period;

The processor sends an output command signal to the controller, so as to acquire output signals of output terminals of respective sampling channels which are saved in respective sampling modules controlled by the controller;

Wherein, the first duration is greater than or equal to the duration during which sampling of the sampling channels corresponding to all the sampling modules controlled by the controller is completed.

Figure 16:
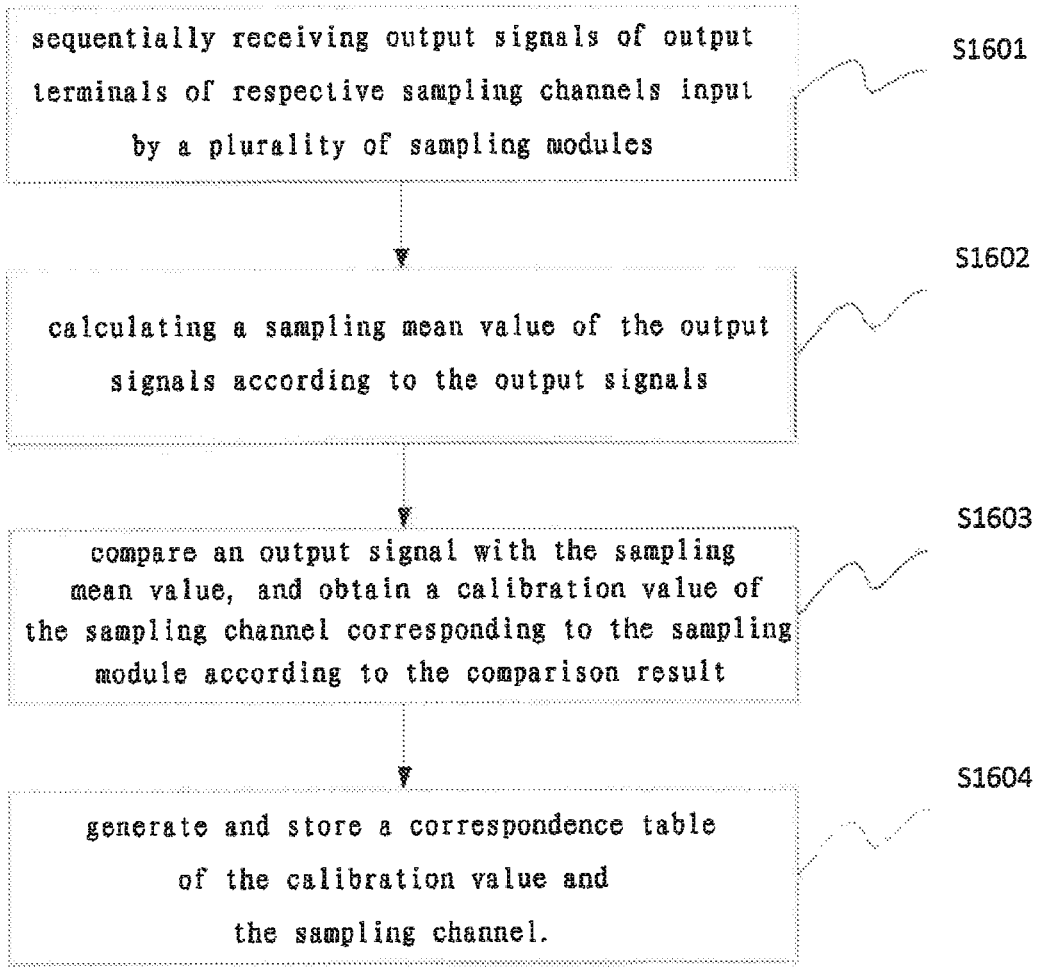
FIG. 16 is a schematic diagram of calculation flowchart of a sampling control method according to an embodiment of the present disclosure.

Further, in a specific implementation, as shown in FIG. 16, in the sampling control method provided by the embodiment of the present disclosure, with respect to the sampling result provided when the controller operates in the calibration mode, the processor performs the following calibration steps:

S1601: Sequentially receiving output signals of output terminals of respective sampling channels input by the plurality of sampling modules;

S1602: Calculating a sampling mean value of the output signals according to the output signals;

S1603: Compare output signals of output terminals of respective sampling channels corresponding to the sampling modules with the sampling mean value, and obtain a calibration value of the sampling channel corresponding to the sampling module according to the comparison result;

S1604: Generate and store a correspondence table between the calibration value and the sampling channel.

The illustration is made by taking the following example: the controller is a logic control circuit, the sampling device is a driving chip provided with a logic control circuit and a sampling module, and the processor is a timing control module.

Specifically, in a specific implementation, in the sampling control method provided by the embodiment of the present disclosure, after sampling of the sampling modules in all the driving chips is completed, the timing control module inputs and outputs an command signal TX_STB1 to a driving chip, to control the control module to start transmitting output signals of output terminals of respective sampling modules which are collected by each sampling module on the driving chip. After the T-CON receives the output signals of the output terminals of the sampling channels corresponding to all the sampling modules, an address is set for each sampling module and each sampling channel corresponding to the sampling module. After the driving chip completes transmitting the output signal to the T-CON, TX_STB2 is transmitted to the next driving chip cascaded with the driving chip, to control the next driving chip to start transmitting to the timing control module output signals of sampling channels corresponding to sampling modules on the driving chip. After receiving the output signals of sampling channels corresponding to all the sampling modules, the T-CON sets an address for each sampling module and each sampling channel corresponding to the sampling module, . . . and so on. After all driving chips completed transmitting the output signals to the T-CON, the T-CON establishes the correspondence relationship between the calibration values and the sampling channels for the output signals input by all the sampling modules and the sampling channels corresponding to the sampling module, wherein SENSE represents the sampling module, and CH represents the sampling channel. Assuming that there are N SENSEs and M CHs, each SENSE corresponds to L CHs. Each cell in the table corresponds to the calibration information input by a sampling module or sampling channel and its corresponding address. T-CON saves this table in the T-CON.

TABLE 1

| | | | |
|---|---|---|---|
| | SENSE 1 | | |
| CH 1 | CH 2 | . . . | CH L |
| | SENSE 2 | | |
| CH L + 1 | CH L + 2 | . . . | CH 2L |
| | . . . | | |
| | SENSE N | | |
| CH M − L + 1 | CH M − L + 2 | . . . | CH M |

Further, in a specific implementation, in the sampling control method provided by the embodiment of the present disclosure, after receiving the output signals input by the sampling channels corresponding to all the sampling modules, the T-CON calculates a sampling mean value according to the output signals. The output signals of the sampling channels corresponding to each sampling module saved in Table 1 are compared with the sampling mean value, to obtain the calibration value of the sampling module, and the sampling channel calibration value corresponding to each sampling module is saved in Table 1 at a position corresponding to the sampling channel, so as to calibrate the luminance information of the pixel unit input by the sampling module and the sampling channel in the sampling mode.

Further, in a specific implementation, in the sampling control method provided by the embodiment of the present disclosure, with respect to the sampling result provided when the driving chip operates in the sampling mode, the following processing steps are performed:

Looking up a pre-acquired calibration value corresponding to the sampling channel in a correspondence table between the calibration value and the sampling channel;

The sampling result of the sampling channel is calibrated using the pre-acquired calibration value.

Specifically, in the sampling control method provided by the embodiment of the present disclosure, in the sampling mode, the sampling module inputs the luminance information of the pixel unit acquired by the sampling channel corresponding to the sampling module into the T-CON, and the T-CON looks up the pre-acquired calibration value corresponding to the sampling channel in the table of correspondence between the calibration value and the sampling channel which has been saved in the T-CON using the addressing mode, calibrates the luminance information input by the sampling channel using the calibration value to obtain the calibrated luminance information, and inputs the luminance information into the pixel driving circuit to adjust the luminance of the pixel unit.

Further, in a specific implementation, in the sampling control method provided by the embodiment of the present disclosure, the sampling mean value may be, for example, a normal distribution mean value obtained by a normal distribution algorithm or an arithmetic mean value. Of course, it is not limited to these two algorithms. In particular, the calculation method can be designed as needed, any calculation method consistent with the principles of the present disclosure is feasible, and is not limited herein.

Further, in a specific implementation, in the sampling control method provided by the embodiment, the calibration value may be, for example, a ratio of the sampling mean value to an output signal of a sampling channel corresponding to the sampling module. Of course, the calculation of the calibration value is not limited to the ratio, which can be designed as needed, and is not limited herein.

Specifically, in the sampling control method provided by the embodiment of the present disclosure, the T-CON calibrates the luminance information of the pixel unit input by the sampling channel corresponding to the sampling module, and specifically includes:

If the output signal acquired by the sampling module is larger than the sampling mean value, the luminance information input by the sampling module is reduced by using the calibration value;

If the output signal acquired by the sampling module is smaller than the sampling mean value, the luminance information input by the sampling module is increased by using the calibration value.

Further, in a specific implementation, in the sampling control method provided by the embodiment of the present disclosure, in the calibration mode, by inputting a unique calibration source as a standard signal to the sampling channel corresponding to each sampling module, the output signal of the output terminal of the sampling channel is obtained. The output signal is input to the T-CON to calculate a sampling mean value, and then the output signal of each sampling channel corresponding to each sampling module is compared with the sampling mean value. According to the comparison result, a calibration value is obtained and stored at the corresponding storage location of the sampling channel corresponding to the sampling module in the T-CON. In the sampling mode, when the sampling channel corresponding to the sampling module inputs the luminance information of the pixel unit acquired by the sampling channel to the T-CON, the luminance information is calibrated by using the calibration value corresponding to the sample channel saved in the T-CON, so as to eliminate the sampling error caused by the different sampling parameters of the sampling channel and the sampling module, and improve the accuracy of the sampling result.

It should be noted that, in the sampling method provided by the embodiment of the present disclosure, before the sampling is performed, the driving chip operates in the calibration mode, and calibrates each sampling module and each sampling channel to obtain the calibration value of the sampling channel corresponding to the sampling module, and then the driving chip operates in the sampling mode, to sample the luminance information of the pixel unit. Of course, the driving chip may start sampling directly without calibration, or the driving chip may perform calibration action separately. The sampling mode and the calibration mode are independent. In the sampling method provided by the embodiment of the present disclosure, the driving chip may operate independently in any mode, which is not limited herein.

The details will be described below in conjunction with specific embodiments. It should be noted that the present embodiment is to better explain the sampling method and the sampling control method provided by the present disclosure, but does not limit the sampling method and the sampling control method provided by the present disclosure.

Assuming that the driving chip operates in the calibration mode first, and then operates in the sampling mode.

In the calibration mode, the processor performs the following calibration steps: receiving sequentially the output signals of the output terminals of respective sampling channels input by said N sampling modules; calculating a sampling mean value of the output signals according to the output signals; comparing the output signals of output terminals of respective sampling channels connected to the sampling module with the sampling mean value, and obtaining a calibration value of the sampling channel corresponding to the sampling module according to the result of the above comparison; and generating and storing a correspondence table between the calibration value and the sampling channel.

In the sampling mode, the sampling modules simultaneously samples the sampling channels corresponding to the sampling modules.

After the sampling modules complete sampling, the processor performs the following processing steps: looking up a pre-acquired calibration value corresponding to the sampling channel in the correspondence table between the calibration value and the sampling channel; calibrating the output signals by using the pre-acquired calibration value.

For example, the display panel includes a T-CON and a driving chip. The driving chip is provided with 15 sampling modules and a panel, and the panel is provided with 240 sampling channels, that is, each sampling module correspondingly samples 16 sampling channels; That is, the first sampling module samples the first to the 16th sampling channels, the second sampling module samples the 17th to the 32th sampling channels, . . . and so on, and the 15th sampling module samples the 225th to the 240th sampling channels. The logic control circuit is provided in the driving chip, and the logic control circuit can output a control signal for controlling the sampling module and the sampling channel to operate. The signal for controlling the sampling module can be, for example, a module control signal SW1, and 15 sampling modules correspond to 15 module control signals SW1[0]~SW1[14]. The signal for controlling the sampling channel can be, for example, the channel control signal SW2, and each sampling module correspondingly controls 16 sampling channels, that is, corresponds to 16 channel control signals SW2[0]~SW2[15].

At the same time, a calibration source is disposed in the PCB. Specifically, in the sampling control provided by the embodiment of the present disclosure, the calibration source is a constant standard signal, for example, a constant current or a constant voltage. All the driving chips are connected to the PCB. The operation mode pin on the driving chip selects the sampling mode while receiving a high level, and selects the calibration mode while receiving a low level.

The T-CON sends a low-level operating mode select signal SEN-EN to the operating mode selection pin on the driving chip, which causes the driving chip to start the calibration operation.

T-CON outputs a cascade control signal calib1 to control the driving chip to start operation. The logic control circuit in the driving chip turns on the module control signal SW1[0] to control the first sampling module to be turned on; the logic control circuit sequentially turns on L channel control signals SW2[0]~SW2[15], and the L sampling channels corresponding to the sampling module are controlled to be turned on sequentially, and the calibration source is sequentially input as the standard signal to the sampling channel to obtain an output signal of the output terminal of the sampling channel Specifically, when the logic control circuit in the driving chip outputs the module control signal SW2[0], the calibration source is input as a standard signal to the first sampling channel corresponding to the first sampling module, and the output signal of the output terminal of the first sampling channel is obtained. When the logic control circuit outputs the module control signal SW2[1], the calibration source is input as a standard signal to the second sampling channel corresponding to the first sampling module, and an output signal of the output terminal of the second sampling channel is obtained; . . . and so on, when the logic control circuit outputs the module control signal SW2[15], the calibration source is input as a standard signal to 16 sampling channels corresponding to the first sampling module, the output signal of the output terminal of the Lth sampling channel is obtained. After the first sampling module completes sampling, the logic control circuit outputs a module control signal SW1[1] to control the second sampling module to be turned on. The logic control circuit in the driving chip sequentially turns on 16 channel control signals SW2[0]~SW2[15], sequentially controls L sampling channels corresponding to the second sampling module to be turned on. The calibration source is sequentially input as the standard signal into the sampling channel to obtain an output signal of the output terminal of the sampling channel. That is, when the logic control circuit sends the module control signal SW2[0], the calibration source is input as a standard signal to the 17th sampling channel corresponding to the second sampling module, to obtain an output signal of the output terminal of the 17th sampling channel. When the logic control circuit outputs the module control signal SW2[1], the calibration source is input as the standard signal to the 18th sampling channel corresponding to the second sampling module, to obtain an output signal of the output terminal of the 18th sampling channel, . . . and so on. When the logic control circuit outputs the module control signal SW2[15], the calibration source is input as the standard signal to the 32th sampling channel corresponding to the second sampling module, to obtain an output signal of the output terminal of the 32th sampling channel. After the second sampling module completes sampling, the logic control circuit outputs a module control signal SW1[2] to control the third sampling module to be turned on . . . and so on. Accordingly, after the 14th sampling module completes sampling, the logic control circuit in the driving chip outputs the module control signal SW1[14], to control the 15th sampling module to be turned on. The logic control circuit sequentially turns on 16 channel control signals SW2[0]~SW2[15], and 16 sampling channels corresponding to the 15th sampling module are controlled to be turned on sequentially, and the calibration source is sequentially input as the standard signal to the sampling channel to obtain an output signal of the output terminal of the sampling channel. That is, when the logic control circuit outputs the module control signal SW2[0], the calibration source is input as a standard signal to the 225th sampling channel corresponding to the 15th sampling module, and the output signal of the output terminal of the 225th sampling channel is obtained. When the logic control circuit outputs the module control signal SW2[1], the calibration source is input as a standard signal to the 226th sampling channel corresponding to the 15th sampling module, and an output signal of the output terminal of the 226th sampling channel is obtained; . . . and so on. When the logic control circuit outputs the module control signal SW2[15], the calibration source is input as a standard signal to the 240th sampling channels corresponding to the 15th sampling module, the output signal of the output terminal of the 240th sampling channel is obtained.

After 15 sampling modules complete the sampling, that is, after the time during which sampling of 240 sampling channels is completed elapses, the T-CON outputs an output command signal TX_STB1 to the driving chip, and controls the driving chip to transmit to the T-CON output signals of the output terminals of respective sampling channels collected by all sampling modules in the driving chip, to calibrate each sampling module and sampling channel and eliminate error. Specifically, the driving chip inputs the output signals of the D0~Dn bits into the T-CON through multiple pulse signals. The acquired output signals are sequentially input to the T-CON. After receiving the output signals of the sampling channels corresponding to all the sampling modules, the T-CON sets an address for each sampling module and each sampling channel corresponding to the sampling module. T-CON establishes the correspondence relationship between the calibration values and the sampling channels with respect to the output signals input by all the sampling modules and the sampling channels corresponding to the sampling module, and saves this table in the T-CON, wherein SENSE represents the sampling module, CH represents the sampling channel, and the number is the number of each sampling module and sampling channel.

TABLE 2

| | | | |
|---|---|---|---|
| SENSE 1 | | | |
| CH 1 | CH 2 | . . . | CH 16 |
| SENSE 2 | | | |
| CH 17 | CH 18 | . . . | CH 32 |
| . . . | | | |
| SENSE 15 | | | |
| CH 225 | CH 226 | . . . | CH 240 |

At the same time, T-CON can use all of the received output signals to perform normal distribution calculation, takes the highest distribution frequency in the normal distribution technique as a sampling mean value, and compares the output signal of the sampling channel corresponding to each sampling module saved in Table 2 with the sampling mean value, to obtain the calibration value of the sampling channel corresponding to each sampling module, that is, the ratio of the output signal input by the sampling channel to the sampling mean value; and the calibration value is saved in Table 2 at a storage location corresponding to the sampling channel.

The T-CON sends an operation mode select signal SEN-EN at a high level to the operating mode select pin on the driving chip, to enable the driving chip to select the sampling mode.

The logic control circuit sequentially outputs 16 channel control signals SW2[0]~SW2[15], and each channel control signal is configured to control a group of sampling channels to be simultaneously turned on, thereby controlling 15 sampling modules simultaneously sample 16 sampling channels corresponding to the sampling module respectively, to obtain the luminance information of the pixel unit. Specifically, as shown in FIG. 10, the white squares in the figure represent respective sampling modules, the numbers in the white squares indicate the numbers of the sampling modules among the 1st~15th sampling modules, and the black squares indicate respective sampling channels, the numbers in the black squares indicate the numbers of the sampling channels in the 1st~240th sampling channels. The first sampling module correspondingly samples the 1st to 16th sampling channels, the second sampling module correspondingly samples the sampling 17th to 32th sampling channels . . . and so on, and the 15th sampling module correspondingly samples the 225th to 240th sampling channels. Wherein the first sampling channel in the sampling channels corresponding to respective sampling modules constitutes the first group of sampling channels Y1, the second sampling channel in the sampling channels corresponding to respective sampling modules constitutes the second group of sampling channel Y2 . . . and so on, and the 16th sampling channel in the sampling channels corresponding to respective sampling modules constitutes the 16th group of sampling channel Y16. The logic control circuit sequentially outputs the channel control signals SW2[0]~SW2[15] to control each group of sampling channels to be simultaneously turned on. That is, when the logic control circuit outputs the module control signal SW2[0] to the first group of sampling channel Y1, each sampling module simultaneously samples the first sampling channel corresponding to the sampling module, and when the logic control circuit outputs the module control signal SW2[1] to the second group sampling channel Y2, each sampling module simultaneously samples the second sampling channel corresponding to the sampling module, . . . and so on. When the logic control circuit outputs the module control signal SW2[15] to the 16th sampling channel Y16, each sampling module simultaneously samples the 16th sampling channel corresponding to the sampling module. In this way, 15 sampling modules complete sampling of all sampling channels. Thus, by controlling all sampling modules simultaneously start sampling of the sampling channels corresponding to the sampling module respectively, during the sampling modules samples 16 sampling channels, sampling of 240 sampling channels is completed, which greatly shortens the sampling time of the luminance information of each pixel unit, thereby improving the speed of adjusting the luminance of the pixel unit and improving the luminance uniformity of the display panel.

After the sampling module in the driving chip completes sampling, the T-CON outputs an output command signal TX_STB1 to the driving chip, and controls the driving chip to transmit the acquired luminance information of the pixel unit to the T-CON, and the driving chip inputs to the T-CON the luminance information of the D0~Dn bits through multiple pulse signals. T-CON looks up the pre-acquired calibration value corresponding to the sampling channel in the table (table 2) of correspondence between the calibration value and the sampling channel which has been saved in the T-CON using the addressing mode, calibrates the luminance information input by the sampling channel using the calibration value to obtain the calibrated luminance information, and inputs the luminance information into the pixel driving circuit to adjust the luminance of the pixel unit, so as to eliminate the sampling error caused by the different sampling parameters of the sampling channel and the sampling module, and improve the accuracy of the sampling result.

Figure 17:
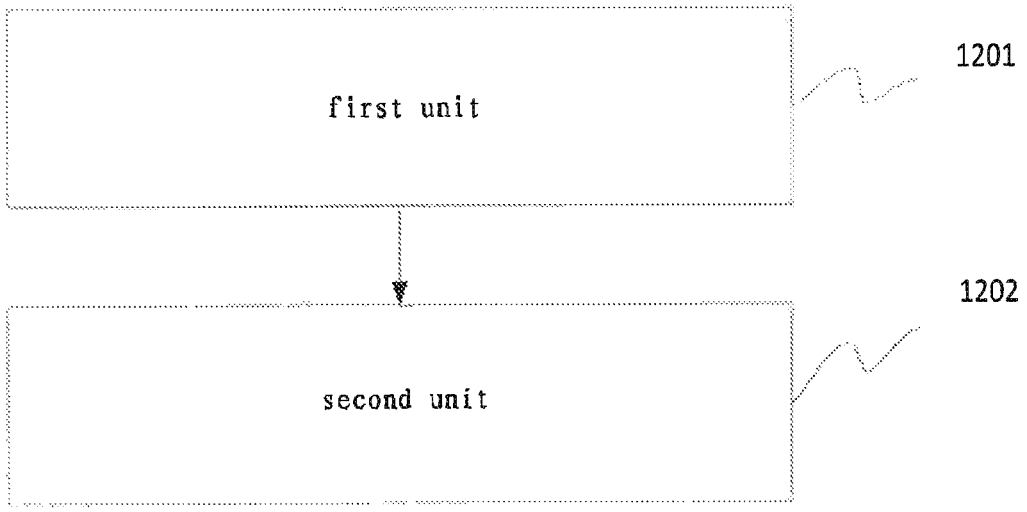
FIG. 17 is a schematic structural diagram of a sampling device according to an embodiment of the present disclosure.

Based on the same inventive concept, an embodiment of the present disclosure provides a sampling device. As shown in FIG. 17, the device includes:

The first unit 1201 is configured to control the plurality of sampling modules to be simultaneously turned on, so that the plurality of sampling modules are capable of receiving and saving the luminance information of the pixel units obtained through sampling of the sampling channel; wherein, Each sampling module is connected to a plurality of sampling channels, each sampling channel includes an input terminal for sampling luminance information of a pixel unit of a partial region on the display substrate, and an output terminal for transmitting the luminance information obtained by sampling to a sampling module connected to the sampling channel; the sampling module is configured to receive and save luminance information input by the sampling channel;

The second unit 1202 is configured to sequentially control a group of sampling channels to be simultaneously turned on, so that the group of sampling channels simultaneously samples the luminance information, and transmits the sampled luminance information to respective sampling modules connected to the group of sampling channels through the output terminal of the group of sampling channels; wherein The sampling channels that are turned on simultaneously belong to a group of sampling channels, and respective sampling channels in each group of sampling channels are connected to different sampling modules respectively.

Optionally, the sampling device provided by the embodiment of the present disclosure performs the step of controlling the plurality of sampling modules to be simultaneously turned on when the first unit receives the sampling mode selection signal sent by the processor.

Optionally, the foregoing sampling device provided by the embodiment of the present disclosure further includes: a calibration sampling unit;

The calibration sampling unit is configured to:

When the first unit receives the calibration mode selection signal sent by the processor, the plurality of sampling modules are sequentially turned on, so that the plurality of sampling modules are capable of receiving and saving the output signal of the output terminal of the sampling channel;

Wherein, after the first unit controls each sampling module to be turned on, the plurality of sampling channels connected to the sampling module are sequentially turned on, so that the input terminal of the sampling channel sequentially receives the signal input by the calibration source, and samples the calibration source. Wherein the calibration source is configured to provide a standard signal to the input terminal of the sampling channel when the controller receives the calibration mode selection signal sent by the processor.

Optionally, the sampling device provided by the embodiment of the present disclosure has the same input signals at the input terminals of respective sampling channels, which are a standard signal provided by the same calibration source.

Optionally, in the foregoing sampling device provided by the embodiment of the present disclosure, the first unit and the sampling module are disposed in a same sampling chip, and the calibration sampling unit is further configured to:

After the first unit determines that the sampling chip to which the first unit belongs completes sampling, the first unit sends a cascade control signal to a first unit of a next sampling chip that is cascaded with the sampling chip, so that the first unit in the next sampling chip controls a plurality of sampling modules in the next sampling chip to be sequentially turned on.

Optionally, the foregoing sampling device provided by the embodiment of the present disclosure further includes: an information output unit;

The information output unit is configured to:

When receiving the output command signal sent by the processor, the controller controls respective sampling modules to send the saved signals from the respective sampling channels to the processor.

Figure 18:
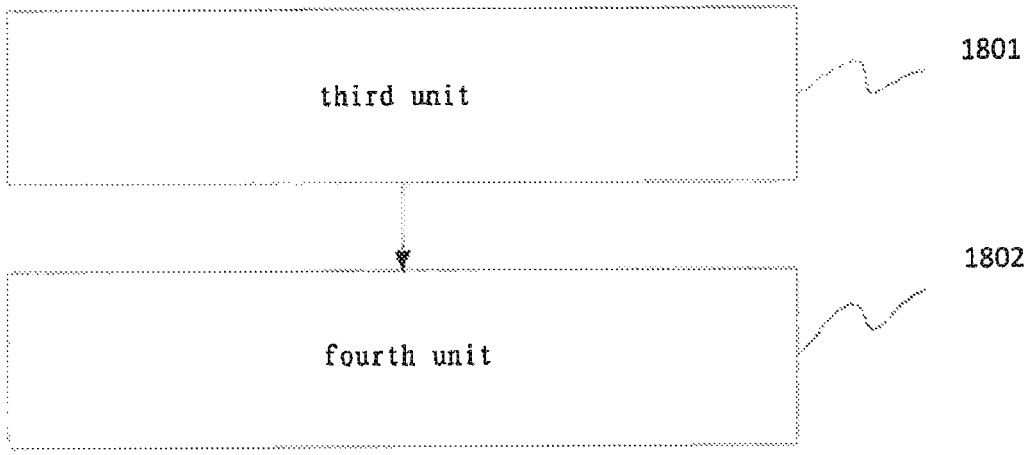
FIG. 18 is a schematic structural diagram of a sampling control device according to an embodiment of the present disclosure.

Based on the same inventive concept, as shown in FIG. 18, an embodiment of the present disclosure provides a sampling control device, where the device includes:

a third unit 1801, configured to determine a mode in which the controller needs to operate;

a fourth unit 1802, configured to, when the third unit determines that the controller needs to operate in the sampling mode, send a sampling mode selection signal to the controller, so that the controller controls the multiple sampling modules to be simultaneously turned on, so that the plurality of sampling modules controlled by the controller are capable of receiving and storing luminance information of the pixel units sampled for the sampling channel; wherein each sampling module is connected to the plurality of sampling channels, each sampling channel includes an input terminal and an output terminal, said input terminal is configured to sample luminance information of a pixel unit of a partial region on the display substrate, and said output terminal is configured to transmit the luminance information obtained by sampling to a sampling module connected to the sampling channel; the sampling module is configured to receive and save luminance information input by the sampling channel; and the controller sequentially controls a group of sampling channels to be simultaneously turned on, so that the group of sampling channels simultaneously sample the luminance information, and transmit the sampled luminance information to respective sampling modules connected to the group of sampling channels through the output terminal of the group of sampling modules; wherein the sampling channels that are turned on at the same time belong to a group of sampling channels, and respective sampling channels in each group of sampling channels are connected to different sampling modules respectively.

Optionally, in the foregoing sampling control device provided by the embodiment of the present disclosure, the fourth unit is further configured to:

When the third unit determines that the controller is required to operate in the calibration mode, sending a calibration mode selection signal to the controller, so that the controller controls the plurality of sampling modules to be sequentially turned on, thus the plurality of sampling modules controlled by the controller controls are capable of receiving and saving an output signal of the output terminal of the sampling channel; wherein, after controlling each of the sampling modules to be turned on, the controller controls a plurality of sampling channels connected to the sampling module to be sequentially turned on, so that the input terminal of the channel sequentially receives the signal input by the calibration source, and samples the calibration source; wherein the calibration source is configured to provide a standard signal to the input terminal of the sampling channel when the controller receives the calibration mode selection signal sent by the processor.

Optionally, the foregoing sampling control device provided by the embodiment of the present disclosure further includes:

Send instruction unit which is configure for:

Obtaining sampling results from the respective sampling channels saved in the sampling module controlled by the controller after the first time period;

Sending an output command signal to the controller, so as to acquire output signals of output terminals of respective sampling channels saved by respective sampling modules controlled by the controller;

Wherein, the first duration is greater than or equal to the duration during which sampling of the sampling channels corresponding to all the sampling modules controlled by the controller is completed.

Optionally, the foregoing sampling control device provided by the embodiment of the present disclosure further includes: a calculating unit;

With respect to the sampling results provided when the controller is operating in the calibration mode, the calculation unit performs the following calibration steps:

Receiving sequentially output signals of output terminals of respective sampling channels input by the plurality of sampling modules;

Calculating a sampling mean value of the output signal according to the output signal;

Comparing the output signals of output terminals of respective sampling channels connected to the sampling module with the sampling mean value, and obtaining a calibration value of the sampling channel corresponding to the sampling module according to the comparison result;

Generating and storing a table of correspondence between the calibration value and the sampling channel.

Optionally, the foregoing sampling control device provided by the embodiment of the present disclosure further includes: a calibration unit;

With respect to the sampling result provided when the driving chip operates in the sampling mode, the calibration unit performs the following processing steps:

Looking up a pre-acquired calibration value corresponding to the sampling channel in a table of correspondence between the calibration value and the sampling channel;

Calibrating the sampling result of the sampling channel by using the pre-acquired calibration value.

Optionally, in the foregoing sampling control device provided by the embodiment of the present disclosure, the sampling mean value is an average value obtained by performing a normal distribution operation on the output signal.

Optionally, in the foregoing sampling control device provided by the embodiment of the present disclosure, the calibration value is a ratio of the output signal to the calibration mean value.

Based on the same inventive concept, an embodiment of the present disclosure provides a sampling control system, including the sampling device of any of the above.

Optionally, the foregoing sampling control system provided by the embodiment of the present disclosure further includes the sampling control device described in any of the above.

Based on the same inventive concept, an embodiment of the present disclosure provides a display device including the above-described sampling control system provided by an embodiment of the present disclosure. The display device can be any product or component having a display function, such as a mobile phone, a tablet computer, a television, a display, a notebook computer, a digital photo frame, a navigator, and the like. Other indispensable components of the display device are understood by those skilled in the art, and are not described herein, nor be construed as limitation to the disclosure. For the implementation of the display device, reference may be made to the embodiment of the above package structure, and the repeated description is omitted.

In summary, according to the foregoing solution provided by the embodiment of the present disclosure, by controlling a plurality of sampling modules sample the luminance information of pixel units corresponding to respective sampling modules, sampling of the luminance information of pixel units in a whole display panel can be completed in a sampling period by respective sampling modules, which shortens the sampling time of the luminance information of the pixel unit, thereby improving the speed of adjusting the luminance of the pixel unit and improving the luminance uniformity of the display panel. By controlling each sampling module sample the pixel unit corresponding to the sampling module before the sampling module starts sampling, and perform calibration after comparing it with the preset standard luminance information, thereby eliminating the sampling error and improving the accuracy of the sampling result.

Those skilled in the art will appreciate that embodiments of the present disclosure can be provided as a method, system, or computer program product. Accordingly, the present disclosure may take the form of an entire hardware embodiment, an entire software embodiment, or a combination of software and hardware aspects. Moreover, the present disclosure may take the form of a computer program product embodied on one or more computer-usable storage media (including but not limited to disk storage and optical storage, etc.) including computer usable program code.

The present disclosure is described with reference to flowchart illustrations and/or block diagrams of methods, apparatus (systems), and computer program products according to embodiments of the present disclosure. It will be understood that each flow and/or block of the flowchart illustrations and/or block diagrams and a combination of flow and/or block of the flowchart illustrations and/or block diagrams may be implemented by computer program instructions. These computer program instructions can be provided to a processor of a general purpose computer, a special purpose computer, an embedded processor, or other programmable data processing apparatus to produce a machine, so that means for implementing the functions specified in one or more flows of the flow chart and/or in a block or blocks of the block diagram may be produced by the instructions executed by a processor of a computer or other programmable data processing apparatus.

The computer program instructions can also be stored in a computer readable memory that can direct a computer or other programmable data processing apparatus to operate in a particular manner, such that the instructions stored in the computer readable memory produce an article of manufacture comprising the instruction device. The instruction device implements the functions specified in one or more flows of the flow chart and/or in a block or blocks of the block diagram.

These computer program instructions can also be loaded onto a computer or other programmable data processing apparatus, such that a series of operational steps are executed on a computer or other programmable apparatus to produce computer-implemented processing, so that the instructions executed on a computer or other programmable apparatus provide steps for implementing the functions specified in one or more flows of the flow chart and/or in a block or blocks of the block diagram.

It will be apparent to those skilled in the art that various changes and modifications can be made to the present disclosure without departing from the spirit and scope of the disclosure. Thus, if these changes and modifications to the present disclosure fall into the scope of the claims of the present disclosure and equivalents thereof, it is intended that the present disclosure covers these changes and modifications.

The present application claims the priority of Chinese patent application No.: 201711350617.6 filed on Dec. 15, 2017, which is incorporated by reference herein in its entirety as part of the present application.

What is claimed is:

1. A sampling method for sampling pixel units disposed on a display substrate by using N sampling modules disposed on a sampling chip, M sampling channels are disposed on the display substrate, said M sampling channels are divided into N sampling channel sets, each sampling channel set comprises at least two sampling channels, each of said N sampling modules is connected to the at least two sampling channels within a corresponding sampling channel set of said N sampling channel sets, said M sampling channels comprise input terminals and an output terminals, the method comprising:

a controller controlling said N sampling modules to be simultaneously turned on, so that said N sampling modules controlled by the controller are capable of receiving luminance information of the pixel units which is obtained through sampling of the sampling channel and input by the sampling channel; and the controller controlling a group of sampling channels to be simultaneously turned on in a sequence from the first sampling channel to the last sampling channel in each sampling channel set, respective sampling channels in said group of sampling channel being connected to different sampling modules respectively, so that the group of sampling channels simultaneously sample the luminance information through the input terminals of the group of sampling channels, and transmit as output signals the sampled luminance information to respective sampling modules connected to the group of sampling channels through the output terminals of the group of sampling channels.

2. The method according to claim 1, wherein when the controller receives a sampling mode selection signal sent by a processor, the step of controlling said N sampling modules to be simultaneously turned on is performed.

3. The method according to claim 2, wherein the method further comprises:

when the controller receives a calibration mode selection signal sent by the processor, the controller controls said N sampling modules to be sequentially turned on, so that said N sampling modules controlled by the controller are capable of receiving the output signals of the output terminals of the sampling channels;

wherein, during controlling each sampling module to be turned on, the controller controls said at least two sampling channels connected to the sampling module to be sequentially turned on, so that the input terminals of the sampling channels sequentially receive the signal input by a calibration source; wherein the calibration source is configured to provide a standard signal to the input terminal of the sampling channel when the controller receives the calibration mode selection signal sent by the processor.

4. The method according to claim 1, wherein the controller and the sampling module are disposed in a same sampling chip, the method further comprising:

after the controller determines that the sampling chip to which the controller belongs completes sampling, the controller sends a cascade control signal to a controller in a next sampling chip cascaded with the sampling chip to which the controller belongs, so that the controller in the next sampling chip controls N sampling modules in the next sampling chip to be sequentially turned on.

5. A sampling control method for controlling a sampling method for sampling pixel units disposed on a display substrate by using N sampling modules disposed on a sampling chip, M sampling channels are disposed on the display substrate, said M sampling channels are divided into N sampling channel sets, each sampling channel set comprises at least two sampling channels, each of said N sampling modules is connected to the at least two sampling channels within a corresponding sampling channel set of said N sampling channel sets, said M sampling channels comprise input terminals and an output terminals, the method comprising:

a processor determines whether a controller needs to operate in a sampling mode or a calibration mode;

when it is determined that the controller needs to operate in the sampling mode, the processor sends a sampling mode selection signal to the controller, so that the controller controls said N sampling modules to be simultaneously turned on, so that said N sampling modules controlled by the controller are capable of receiving luminance information of the pixel units which is obtained through sampling of the sampling channel and input by the sampling channel; and controls a group of sampling channels to be simultaneously turned on in a sequence from the first sampling channel to the last sampling channel in each sampling channel set, respective sampling channels in said group of sampling channel being connected to different sampling modules respectively, so that the group of sampling channels simultaneously sample the luminance information through the input terminals of the group of sampling channels, and transmit as output signals the sampled luminance information to respective sampling modules connected to the group of sampling channels through the output terminals of the group of sampling channels.

6. The method according to claim 5, wherein the method further comprises:

when it is determined that the controller needs to operate in the calibration mode, the processor sends a calibration mode selection signal to the controller, so that the controller controls said N sampling modules to be sequentially turned on, and said N sampling modules controlled by the controller are capable of receiving the output signals from the output terminals of the sampling channels; wherein, during the controller controlling each sampling module to be turned on, the controller controls said at least two sampling channels connected to the sampling module to be sequentially turned on, so that the input terminal of the sampling channel sequentially receives a signal input by the calibration source; wherein, the calibration source is configured to provide a standard signal to the input terminal of the sampling channel, when the controller receives the calibration mode selection signal sent by the processor.

7. The method according to claim 5, wherein the method further comprises:

the processor acquires the output signals from respective sampling channels which are received by the sampling module controlled by the controller after a first time period;

the processor sends an output command signal to the controller, so as to acquire the output signals of output terminals of respective sampling channels which are received by respective sampling modules controlled by the controller;

wherein, the first time period is greater than or equal to the duration during which sampling of the sampling channels corresponding to all the sampling modules controlled by the controller is completed.

8. The method according to claim 5, wherein the method further comprises:

with respect to the output signals provided when the controller operates in the calibration mode, the processor performs the following calibration steps:

sequentially receiving the output signals of the output terminals of respective sampling channels input by said N sampling modules;

calculating an average sampling value of the output signals according to the output signals;

comparing the output signals of the output terminals of respective sampling channels connected to the sampling modules with the sampling mean value, and obtaining a calibration value of the sampling channel corresponding to the sampling module according to the result of the above comparison generating and storing a correspondence table between the calibration value and the sampling channel.

9. The method according to claim 8, wherein the method further comprises:

with respect to the output signals provided when the controller operates in the sampling mode, the processor performs the following processing steps:

looking up a pre-acquired calibration value corresponding to the sampling channel in the correspondence table between the calibration value and the sampling channel;

calibrating the output signals by using the pre-acquired calibration value.

10. A sampling device for sampling pixel units disposed on a display substrate by using N sampling modules disposed on a sampling chip, M sampling channels are disposed on the display substrate, said M sampling channels are divided into N sampling channel sets, each sampling channel set comprises at least two sampling channels, each of said N sampling modules is connected to the at least two sampling channels within a corresponding sampling channel set of said N sampling channel sets, said M sampling channels comprise input terminals and an output terminals, the device comprising:

a controller, comprising a first controlling device and a second controlling device, the first controlling device is configured to control said N sampling modules to be simultaneously turned on, so that said N sampling modules controlled by the first controlling device are capable of receiving luminance information of the pixel units which is obtained through sampling of the sampling channel and input by the sampling channel; and the second controlling device is configured to control a group of sampling channels to be simultaneously turned on in a sequence from the first sampling channel to the last sampling channel in each sampling channel set, respective sampling channels in said group of sampling channel being connected to different sampling modules respectively, so that the group of sampling channels simultaneously sample the luminance information through the input terminals of the group of sampling channels, and transmit as output signals the sampled luminance information to respective sampling modules connected to the group of sampling channels through the output terminals of the group of sampling channels.

11. The device according to claim 10, wherein when the first controlling device receives a sampling mode selection signal sent by a processor, the step of controlling said N sampling modules to be simultaneously turned on is performed.

12. The device according to claim 10, wherein the device further comprises: further includes: a calibration sampling device;

the calibration sampling device is configured to:

when the first controlling device receives a calibration mode selection signal sent by the processor, said N sampling modules are sequentially turned on, so that said N sampling modules are capable of receiving the output signals of the output terminals of the sampling channels;

wherein, during controlling each sampling module to be turned on, the first controlling device controls said N sampling channels connected to the sampling module are sequentially turned on, so that the input terminal of the sampling channel sequentially receives the signal input by the calibration source; wherein, the calibration source is configured to provide a standard signal to the input terminal of the sampling channel when the controller receives the calibration mode selection signal sent by the processor.

13. The device according to claim 10, wherein the first unit and the sampling module are disposed in a same sampling chip, and the calibration sampling unit is further configured to:

after the first controlling device determines that the sampling chip to which the first unit belongs completes sampling, the first controlling device sends a cascade control signal to another first controlling device of a next sampling chip that is cascaded with the sampling chip to which the first controlling device belongs, so that the other first controlling device in the next sampling chip controls N sampling modules in the next sampling chip to be sequentially turned on.

14. A sampling control device for controlling the sampling device according to claim 10, the device comprising:

the controller further comprising a third controlling device and a fourth controlling device, the third controlling device is configured to determine whether the controller needs to operate in a sampling mode or a calibration mode;

the fourth controlling device is configured to, when the third controlling device determines that the controller needs to operate in the sampling mode, send a sampling mode selection signal to the controller.

15. The device according to claim 14, wherein said fourth controlling device is further configured to:

when the third controlling device determines that the controller needs to operate in the calibration mode, send a calibration mode selection signal to the controller, so that the controller controls said N sampling modules to be sequentially turned on, and said N sampling modules controlled by the controller are capable of receiving the output signals of the output terminals of the sampling channels; wherein, during controlling each of the sampling modules to be turned on, the controller controls said at least two sampling channels connected to the sampling module to be sequentially turned on, so that the input terminal of the channel sequentially receives the signal input by the calibration source, and samples the calibration source; wherein, the calibration source is configured to provide a standard signal to the input terminal of the sampling channel when the controller receives the calibration mode selection signal sent by the processor.

16. The device according to claim 14, wherein the device further comprises:

a send instruction device, which is configure to:

obtain the output signals from the respective sampling channels which are received by the sampling module controlled by the controller after a first time period;

send an output command signal to the controller, so as to acquire the output signals of the output terminals of respective sampling channels received by respective sampling modules controlled by the controller;

wherein, the first time period is greater than or equal to the duration during which sampling of the sampling channels corresponding to all the sampling modules controlled by the controller is completed.

17. The device according to claim 14, wherein the device further comprises: a calculating device;

with respect to the output signals provided when the controller is operating in the calibration mode, the calculation device performs the following calibration steps:

receiving sequentially the output signals of the output terminals of respective sampling channels input by said N sampling modules;

calculating a sampling mean value of the output signals according to the output signals;

comparing the output signals of output terminals of respective sampling channels connected to the sampling module with the sampling mean value, and obtaining a calibration value of the sampling channel corresponding to the sampling module according to the result of the above comparison;

generating and storing a correspondence table between the calibration value and the sampling channel.

18. The device according to claim 14, wherein the device further comprises: a calibration device;

with respect to the output signals provided when the sampling chip operates in the sampling mode, the calibration device performs the following processing steps:

looking up a pre-acquired calibration value corresponding to the sampling channel in the correspondence table between the calibration value and the sampling channel;

calibrating the output signal of the sampling channel by using the pre-acquired calibration value.

19. A sampling control system, comprising the sampling control device according to claim 14.

20. A display device, comprising the sampling control system of claim 19.

* * * * *